US007910176B2

(12) United States Patent
Goto et al.

(10) Patent No.: US 7,910,176 B2
(45) Date of Patent: Mar. 22, 2011

(54) ELECTRODE FOR DISCHARGE SURFACE TREATMENT, MANUFACTURING METHOD AND EVALUATION METHOD FOR ELECTRODE FOR DISCHARGE SURFACE TREATMENT, DISCHARGE SURFACE TREATMENT APPARATUS, AND DISCHARGE SURFACE TREATMENT METHOD

(75) Inventors: Akihiro Goto, Tokyo (JP); Masao Akiyoshi, Tokyo (JP); Katsuhiro Matsuo, Nagoya (JP); Hiroyuki Ochiai, Tokyo (JP); Mitsutoshi Watanabe, Tokyo (JP); Takashi Furukawa, Tokyo (JP)

(73) Assignees: Mitsubishi Denki Kabushiki Kaisha, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 1300 days.

(21) Appl. No.: 10/559,427

(22) PCT Filed: Jan. 29, 2004

(86) PCT No.: PCT/JP2004/000848

§ 371 (c)(1), (2), (4) Date: Mar. 14, 2006

(87) PCT Pub. No.: WO2004/108990

PCT Pub. Date: Dec. 16, 2004

(65) Prior Publication Data

US 2006/0169596 A1 Aug. 3, 2006

(30) Foreign Application Priority Data

Jun. 5, 2003 (JP) ..... 2003-160505
Jun. 11, 2003 (JP) ..... 2003-166010
Jun. 11, 2003 (JP) ..... 2003-166017

(51) Int. Cl.
*H05H 1/48* (2006.01)
*C23C 16/48* (2006.01)

(52) U.S. Cl. ..... 427/580; 427/584; 427/587; 427/229

(58) Field of Classification Search ..... 427/580, 427/584, 587, 229
See application file for complete search history.

(56) References Cited

U.S. PATENT DOCUMENTS 5,352,522 A * 10/1994 Kugimiya et al. ..... 428/403
(Continued)

FOREIGN PATENT DOCUMENTS

CN 1367726 9/2002
(Continued)

OTHER PUBLICATIONS

Kiparisov S.S., et al. Powder Mettalurgy, Metallurgy, 1980, p. 199, and p. 204 Moscow.
(Continued)

*Primary Examiner* — Binh X Tran
(74) *Attorney, Agent, or Firm* — Sughrue Mion, PLLC

(57) ABSTRACT

An electrode is used to perform discharge surface treatment of a work piece. The electrode is made of a green compact obtained by compression-molding an electrode material including powder of any of a metal, a metallic compound, and ceramics. The discharge surface treatment includes generating an electric discharge between the electrode and the work piece in an atmosphere of a machining medium and forming a film consisting of a machining material on a surface of a work piece using energy produced by the electric discharge. The powder has an average particle diameter of 5 micrometer to 10 micrometers, and contains 40 volume percent or more of a component not forming or less easily forming carbide as a component for forming the film on the work piece. The electrode has a hardness in a range of B to 8B tested with a pencil scratch test for a coating film.

6 Claims, 11 Drawing Sheets

U.S. PATENT DOCUMENTS

| | | | | |
|---|---|---|---|---|
| 5,994,250 | A * | 11/1999 | Suzuki et al. | 501/87 |
| 6,312,622 | B1 | 11/2001 | Toshima et al. | |
| 6,336,950 | B1 | 1/2002 | Koizumi et al. | |
| 6,441,333 | B1 | 8/2002 | Goto et al. | |
| 6,602,561 | B1 | 8/2003 | Moro et al. | |
| 2001/0013508 | A1 | 8/2001 | Goto et al. | |
| 2002/0000369 | A1 * | 1/2002 | Mohri et al. | 204/192.12 |
| 2003/0089197 | A1 | 5/2003 | Wada et al. | |
| 2006/0021868 | A1 | 2/2006 | Goto et al. | |

FOREIGN PATENT DOCUMENTS

| | | | |
|---|---|---|---|
| CN | 1094407 | C | 11/2002 |
| DE | 197 01 170 | A1 | 7/1997 |
| EP | 1035231 | A1 | 9/2000 |
| EP | 1526191 | A1 | 4/2005 |
| JP | 54-124806 | A | 9/1979 |
| JP | 63-183102 | A | 7/1988 |
| JP | 5-148615 | A | 6/1993 |
| JP | 5-214402 | A | 8/1993 |
| JP | 6-33261 | A | 2/1994 |
| JP | 07-070761 | A | 3/1995 |
| JP | 7-70761 | A | 3/1995 |
| JP | 07070761 | A * | 3/1995 |
| JP | 7-220560 | A | 8/1995 |
| JP | 8-300227 | A | 11/1996 |
| JP | 9-192937 | A | 7/1997 |
| JP | 11-106948 | A | 4/1999 |
| JP | 11-229159 | A | 8/1999 |
| JP | 11229159 | A * | 8/1999 |
| JP | 160505 | A | 6/2003 |
| JP | 166010 | A | 6/2003 |
| JP | 166017 | A | 6/2003 |
| JP | 2003-003204 | A | 8/2003 |
| JP | 2004-76038 | A | 3/2004 |
| JP | 2004-137576 | A | 5/2004 |
| WO | 9918258 | A1 | 4/1999 |
| WO | WO 99/58744 | A1 | 11/1999 |
| WO | WO 01/05545 | A1 | 1/2001 |
| WO | 01/24961 | A1 | 4/2001 |
| WO | WO 01/23640 | A1 | 4/2001 |
| WO | WO 01/55481 | A1 | 8/2001 |

OTHER PUBLICATIONS

Akihiro Goto, et al., "Formation of Hard Layer on Metallic Material by EDM", VDI BERICHTE NR. 1405, 1998 pp. 271-278, Proc. Internationals Symposium for Electro-machining (ISEM 12).

Akihiro Goto, et al., "Development of Electrical Discharge Coating Method", Proc. International Symposium for Electro-Machining (ISEM 13) pp. 581-588.

S. Liu, Prediction of random packing limit for multimodal particle mixtures, Powder Technology 126, pp. 283-296 Alberta Canada, 2002.

* cited by examiner

FILM WITH THICKNESS OF ABOUT 2mm

ELECTRODE FOR DISCHARGE SURFACE TREATMENT, MANUFACTURING METHOD AND EVALUATION METHOD FOR ELECTRODE FOR DISCHARGE SURFACE TREATMENT, DISCHARGE SURFACE TREATMENT APPARATUS, AND DISCHARGE SURFACE TREATMENT METHOD

TECHNICAL FIELD

The present invention relates to an electrode for discharge surface treatment that is used for discharge surface treatment for causing pulsed electric discharge between an electrode for discharge surface treatment, which consists of a green compact obtained by compression-molding powder of metal, a metallic compound, or ceramics, and a work piece and forming, using discharge energy of the electric discharge, a film consisting of an electrode material or a substance generated by reaction of the electrode material due to the discharge energy on a surface of the work piece and a manufacturing method and an evaluation method for the electrode for discharge surface treatment. The present invention also relates to a discharge surface treatment apparatus and a discharge surface treatment method using the electrode for discharge surface treatment.

BACKGROUND ART

Welding and thermal spraying have been conventionally used for surface treatment for a turbine blade and the like of a gas turbine engine for an aircraft because it is necessary to coat or build up a material having strength and lubricity under a high-temperature environment. With the welding and thermal spraying, a film of a material containing Cr (chrome) or Mo (molybdenum), which is known to be oxidized into oxide under the high-temperature environment and show lubricity, as a base is built up thick on a work piece (hereinafter, "work"). The welding refers to a method of melting and depositing a material for a welding rod with electric discharge between the work and the welding rod. The thermal spraying refers to a method of bringing a metal into a fused state and spraying the metal material on the work to form a film.

However, both the welding and the thermal spraying are manual machining and require skill. Thus, there is a problem in that it is difficult to automate the machining and cost for the machining increases. In particular, since the welding is a method of concentrating heat in a work, there is a problem in that weld crack tends to occur when a thin material is treated and when a fragile material, for example, a single crystal alloy or a directional control alloy like a directionally solidified alloy is treated.

As a technology for solving such problems, a method of coating a surface of a metal material used as a work with submerged discharge is proposed. For example, a first conventional technology discloses a technology for performing submerged discharge using an electrode material containing a component of a film to be formed on a work as primary machining and, then, applying re-melting discharge machining to the electrode material deposited on the work using a separate copper electrode or an electrode like graphite that is not worn much (see, for example, Patent Document 1). According to the conventional technology, a coating layer having satisfactory hardness and adhesion is obtained for a steel material used as the work. However, it is difficult to form a coating layer having strong adhesion on a surface of a sintered material like a cemented carbide. The method requires two steps consisting of the first machining for forming a film and the second machining for subjecting the film to re-melting discharge to cause the film to adhere to the work. Thus, there is a problem in that the treatment is complicated.

A second conventional technology discloses a technology for forming a hard ceramic film on a metal surface only through a change in a discharge electrical condition without replacing an electrode in such treatment for forming a film at two steps of machining (see, for example, Patent Document 2). In the second conventional technology, ceramic powder to be used as a material for forming an electrode compression-molded at an extremely high pressure of 10 t/cm$^2$ and pre-sintered to have density of 50% to 90% of a logical density is used as an electrode.

In a third conventional technology, with a material forming hard carbide like Ti (titanium) as an electrode, electric discharge is caused between the electrode and a metal material used as a work. Consequently, a strong hard film is formed on a metal surface without a step of re-melting that is required in the first and the second conventional technologies (see, for example, Patent Document 3). The technology utilizes a phenomenon in which the electrode material worn by electric discharge reacts with C (carbon), which is a component in a machining fluid, to generate TiC (titanium carbide). When a green compact electrode of metal hydride like $TiH_2$ (titanium hydride) is used to cause electric discharge between the green compact electrode and a metal material used as a work, it is possible to form a hard film with satisfactory adhesion faster than using the metal material such as Ti. Moreover, when a green compact electrode formed by mixing hydride such as $TiH_2$ with other metals or ceramics is used to cause electric discharge between the green compact electrode and a metal material used as a work, it is also possible to quickly form a hard film having various characteristic like high hardness and abrasion resistance.

In a fourth conventional technology, ceramic powder is compression-molded, a green compact electrode with high strength is manufactured by pre-sintering, and a film of a hard material such as TiC is formed by electric discharge surface treatment using the electrode (see, for example, Patent Document 4). As an example of the fourth conventional technology, manufacturing of an electrode for discharge surface treatment (hereinafter simply referred to as electrode as well) consisting of powder obtained by mixing tungsten carbide (WC) powder and cobalt (Co) powder is explained. A green compact obtained by mixing and compression-molding the WC powder and the Co powder may be simply obtained by mixing and compression-molding the WC powder and the Co powder. It is more desirable to compression-molding the WC powder and the Co powder after mixing wax therein because moldability of the green compact is improved. However, since the wax is an insulating material, if a large quantity of the wax remains in the electrode, dischargeability is deteriorated because an electrical resistance of the electrode increases. Thus, it is necessary to remove the wax. The wax is removed by putting the green compact in a vacuum furnace and heating the green compact. At this point, if heating temperature is too low, the wax cannot be removed. If heating temperature is too high, the wax changes to soot to deteriorate purity of the electrode. Thus, it is necessary to keep heating temperature at temperature equal to or higher than temperature at which the wax is melted and temperature not more than temperature at which the wax is resolved to be soot. Subsequently, the green compact in the vacuum furnace is heated by a high-frequency coil or the like to give strength durable against machining and sintered not to be hardened excessively, for example, until the green compact becomes as hard as chalk. Such sintering is referred to as pre-sintering. In this case, carbides are mutually bonded in a contact portion thereof. However, since sintering temperature is relatively low and is not as higher as temperature for real sintering, the bonding is weak. When discharge surface treatment is performed with the electrode with high strength sintered by pre-sintering in this way, it is possible to form a dense and homogeneous film on a surface of a work.

Patent Document 1: Japanese Patent Application Laid-Open No. H5-148615

Patent Document 2: Japanese Patent Application Laid-Open No. H8-300227

Patent Document 3: Japanese Patent Application Laid-Open No. H9-192937

Patent Document 4: International Publication No. 99/58744 Pamphlet

As described in the third and the fourth conventional technologies, it is possible to form a dense hard film according to discharge surface treatment using an electrode obtained by sintering a green compact. However, when a thick film is formed with such discharge surface treatment, there is a problem in that there is a significant difference in characteristics of electrodes even if the electrodes are manufactured as disclosed in the fourth conventional technologies. In addition, it is difficult to form a dense film.

As one possible cause of the difference is a difference in distribution of particle diameters of powders of a material of the electrodes. This is because, if there is a difference in distribution of particle diameters of powders with which the electrodes are manufactured, since a hardening condition is different for each of the electrodes even if the electrodes are pressed at the same pressure and formed, a difference in strength of the electrodes occurs finally. Another possible cause of the difference in characteristics of the electrodes is a change of a material (a component) of the electrodes that is performed to change a material of a film to be formed on a work. This is because, when a material of the electrodes is changed, strength of the electrodes differs from strength of the electrodes before the change because of a difference in a physical property value.

It is also known that, when a thin film is formed according to the discharge surface treatment, a way of supply of a material from the electrode side and a way of melting of the material supplied on a surface of a work and bonding of the material with a work material affect film performance most. One index affecting the supply of an electrode material is hardness of the electrode. For example, in the fourth conventional technology, hardness of the electrode for discharge surface treatment is set to hardness that is strength durable against machine machining and is not too high (e.g., hardness equivalent to that of chalk). With the electrode having such hardness, supply of the electrode material by electric discharge is controlled and the material supplied is sufficiently melted. Thus, it is possible to form a hard ceramic film on the surface of the work.

The hardness equivalent to that of chalk, which is the index of hardness of the electrode for discharge surface treatment, is extremely ambiguous. There is also a problem in that a difference of thick films formed on the surface of the work is caused by characteristics such as hardness of the electrode. When a material and a size of powder to be an electrode are changed, a condition for formation of the electrode is different. Therefore, there is a problem in that a step of changing a large number of conditions for formation of the electrode to perform formation tests for a film and deciding a formation condition suitable for use of the material as the electrode for discharge surface treatment is required for each material of the electrode. In other words, there is a problem in that tests for obtaining formation conditions for the electrode for forming a satisfactory film have to be performed a number of times equivalent to types of materials forming the electrodes, which takes a lot of time and labor. Besides, even if electrodes are manufactured by the same manufacturing method using powder of the same material, a volume of the powder changes depending on a season (temperature and humidity). Thus, as in the case of the change of the material, powders with different volumes have to be actually machined to form films and evaluate the electrodes. This takes a lot of time and labor.

Under the present circumstances, the conventional discharge surface treatment mainly aims at formation of a hard film, in particular, formation of a hard film at temperature close to the room temperature to form a film containing hard carbide as a main component. With this method, only a thick film of about 10 micrometers can be formed and it is impossible to increase thickness of a film to be equal to or larger than several tens micrometers. Conventionally, a material easily forming carbide is contained in an electrode at a high rate. For example, if a material such as Ti is contained in an electrode, a chemical reaction is caused by electric discharge in oil. As a result, a hard carbide TiC is obtained as a film. This is because, as surface treatment progresses, a material of a surface of a work changes from a steel material (when the material is machined into a steel material) to TiC, which is ceramics, and characteristics like thermal conduction and a melting point changes.

However, according to an experiment performed by the inventors, the inventors have found that it is possible to increase thickness of a film by adding a material not forming carbide or less easily forming carbide to components of an electrode material. This is because a quantity of materials not changing to carbide and remaining in the film in a metal state increases by adding the material to the electrode. It has been found that selection of an electrode material has a significant meaning in thickly building up a film. In this case, the film to be formed still has hardness, density, and uniformity. However, as described above, the conventional discharge surface treatment mainly aims at formation of a film that shows hardness at temperature close to the room temperature such as TiC and WC. The conventional discharge surface treatment does not pay attention to formation of a dense and relatively thick film (a thin film in an order of 100 micrometers or more) that has lubricity under a high-temperature environment like an application to a turbine blade of a gas turbine engine for an aircraft. Thus, there is a problem in that it is impossible to form such a thick film.

On the other hand, in the second conventional technology, an electrode obtained by compression-molding ceramic powder to be a material forming an electrode at an extremely high pressure of 10 t/cm$^2$ and pre-sintering the material to have density of 50% to 90% of a logical density is used. This is because, for example, (1) since it is an object of the technology to form a thin hard film, a film is strengthened more as an electrode is made harder, and (2) since a main component of a material is ceramics, pressure in compression-molding ceramic powder forming the electrode may be increased. However, when a dense metal film is formed according to the discharge surface treatment, it is impossible to use an electrode manufactured by the method described in the second conventional technology. This is because, when metal powder is pressed at extremely high pressure of 10 t/cm$^2$ as described in the second conventional technology, since an electrode is hardens, it is impossible to form a film according to the discharge surface treatment. If the discharge surface treatment is performed with such an electrode, this results in die sinking for shaving a surface of a work. In the second conventional technology, since ceramic powder is used, no problem is caused even if the ceramic powder is pressed at the high pressure described above to manufacture an electrode for discharge surface treatment. However, the condition cannot be directly applied to an electrode for discharge surface treatment consisting of metal powder. A manufacturing method for an electrode for discharge surface treatment for forming a dense metal thick film according to the discharge surface treatment has not been conventionally known.

The present invention has been devised in view of the circumstances and it is an object of the present invention to obtain an electrode for discharge surface treatment that is capable of easily forming a dense thick film on a work piece according to a discharge surface treatment method.

It is another object of the present invention to obtain an electrode for discharge surface treatment that can form a thick film having lubricity under a high-temperature environment in discharge surface treatment. It is still another object of the present invention to obtain an evaluation method for an electrode for discharge surface treatment for evaluating whether it is possible to use the electrode for discharge surface treatment in formation of a film.

It is still another object of the present invention to obtain an electrode for discharge surface treatment that causes, in discharge surface treatment using metal powder as a green compact electrode, the green compact electrode to perform stable electric discharge without decreasing surface roughness and deposit a thick film.

It is still another object of the present invention to obtain a discharge surface treatment apparatus that uses the electrode for discharge surface treatment and a method for the discharge surface treatment apparatus.

DISCLOSURE OF INVENTION

To achieve the above objects, an electrode for discharge surface treatment according to an aspect of the present invention is used for discharge surface treatment for causing, with a green compact obtained by compression-molding powder of metal, a metallic compound, or ceramics as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, wherein the powder has an average particle diameter of 5 micrometer to 10 micrometers and contains 40 volume percent or more of a mixture of a component for forming the film on the work piece and a component not forming or less easily forming carbide and is formed to have hardness in a range of B to 8B in hardness according to a pencil scratch test for a coating film.

An electrode for discharge surface treatment according to another aspect of the present invention is used for discharge surface treatment for causing, with a green compact obtained by compression-molding powder of metal or a metallic compound as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, wherein compression strength of the electrode is not more than 160 MPa.

An electrode for discharge surface treatment according to another aspect of the present invention is used for discharge surface treatment for causing, with a green compact obtained by compression-molding an electrode material that is powder of metal or a metallic compound as an electrode, electric discharge between the electrode and a work piece in a machining fluid or in an air and forming, using discharge energy of the electric discharge, a film consisting of the electrode material or a substance generated by reaction of the electrode material due to the discharge energy on a surface of the work piece, wherein a volume ratio of the electrode material in a volume of the electrode is 25% to 65%.

An electrode for discharge surface treatment according to another aspect of the present invention is used for discharge surface treatment for causing, with a green compact obtained by compression-molding powder of metal or a metallic compound as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, wherein a thermal conductivity is not more than 10 W/mK.

Moreover, to achieve the above objects, a manufacturing method for an electrode for discharge surface treatment according to another aspect of the present invention includes a first step of grinding powder of metal, a metallic compound, or ceramics; a second step of sieving a mass formed by aggregation of the powder ground to resolve the mass into a size not more than a distance between electrodes; and a third step of changing the powder sieved to a predetermined shape and compression-molding the powder at a pressure of 93 to 278 MPa.

Moreover, to achieve the above objects, a discharge surface treatment method according to another aspect of the present invention of causing, with a green compact obtained by compression-molding powder of metal, a metallic compound, or ceramics as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, comprising preparing a powder that has an average particle diameter of 5 micrometer to 10 micrometers and contains 40 volume percent or more of a mixture of a component for forming the film on the work piece and a component not forming or less easily forming carbide and with a hardness in a range of B to 8B in hardness according to a pencil scratch test for a coating film, and using an electrode made of the powder to form the film.

A discharge surface treatment method according to another aspect of the present invention of causing, with a green compact obtained by compression-molding powder of metal or a metallic compound as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, includes using an electrode having a compression strength of not more than 160 MPa to form the film.

A discharge surface treatment method according to another aspect of the present invention of causing, with a green compact obtained by compression-molding an electrode material that is powder of metal or a metallic compound as an electrode, electric discharge between the electrode and a work piece in a machining fluid or in an air and forming, using discharge energy of the electric discharge, a film consisting of the electrode material or a substance generated by reaction of the electrode material due to the discharge energy on a surface of the work piece, includes using an electrode having a volume ratio of the electrode material in a volume of the electrode 25% to 65% to form the film.

A discharge surface treatment method according to another aspect of the present invention of causing, with a green compact obtained by compression-molding powder of metal or a metallic compound as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, includes using an electrode having a thermal conductivity not more than 10 W/mK to form the film.

Moreover, to achieve the above objects, a discharge surface treatment apparatus according to another aspect of the present invention has an electrode consisting of a green compact obtained by compression-molding powder of metal, a metallic compound, or ceramics and a work piece on which a film is formed, the electrode and the work piece being arranged in a machining fluid or in an air, generates a pulsed electric discharge between the electrode and the work piece using a power supply apparatus electrically connected to the electrode and the work piece, and forms, using discharge energy of the electric discharge, a film consisting of an electrode material or a substance generated by reaction of the electrode material due to the discharge energy on a surface of the work piece, wherein the electrode molds powder with an average particle diameter of 5 to 10 micrometers containing 40 volume percent or more of a mixture of a component for forming the film on the work piece and a component not forming or less easily forming carbide to have hardness in a range of B to 8B in hardness according to a pencil scratch test for a coating film.

A discharge surface treatment apparatus according to another aspect of the present invention has an electrode consisting of a green compact obtained by compression-molding powder of metal or a metallic compound and a work piece on which a film is formed, the electrode and the work piece being arranged in a machining fluid or in an air, generates a pulsed electric discharge between the electrode and the work piece using a power supply apparatus electrically connected to the electrode and the work piece, and forms, using discharge energy of the electric discharge, a film consisting of an electrode material or a substance generated by reaction of the electrode material due to the discharge energy on a surface of the work piece, wherein the electrode has compression strength not more than 160 MPa.

A discharge surface treatment apparatus according to another aspect of the present invention has an electrode consisting of a green compact obtained by compression-molding powder of metal or a metallic compound and a work piece on which a film is formed, the electrode and the work piece being arranged in a machining fluid or in an air, generates a pulsed electric discharge between the electrode and the work piece using a power supply apparatus electrically connected to the electrode and the work piece, and forms, using discharge energy of the electric discharge, a film consisting of an electrode material or a substance generated by reaction of the electrode material due to the discharge energy on a surface of the work piece, wherein in the electrode, a volume ratio of the electrode material in a volume of the electrode is 25% to 65%.

A discharge surface treatment apparatus according to another aspect of the present invention has an electrode consisting of a green compact obtained by compression-molding powder of metal or a metallic compound and a work piece on which a film is formed, the electrode and the work piece being arranged in a machining fluid or in an air, generates a pulsed electric discharge between the electrode and the work piece using a power supply apparatus electrically connected to the electrode and the work piece, and forms, using discharge energy of the electric discharge, a film consisting of an electrode material or a substance generated by reaction of the electrode material due to the discharge energy on a surface of the work piece, wherein the electrode has a thermal conductivity not more than 10 W/mK.

Moreover, to achieve the above objects, an evaluation method for an electrode for discharge surface treatment according to another aspect of the present invention for causing, with a green compact obtained by compression-molding powder of metal or a metallic compound as an electrode, electric discharge between the electrode and a work piece in a machining fluid or in an air and forming, using discharge energy of the electric discharge, a film consisting of an electrode material or a substance generated by reaction of the electrode material due to the discharge energy on a surface of the work piece, includes gradually applying a predetermined load to the electrode; and evaluating, based on compression strength immediately before a crack occurs on the surface of the electrode, whether the electrode is an electrode capable of forming a predetermined film on the surface of the work piece.

BEST MODE(S) FOR CARRYING OUT THE INVENTION

Exemplary embodiments of an electrode for discharge surface treatment, a manufacturing method and an evaluation method for the electrode for discharge surface treatment, a discharge surface treatment apparatus, and a discharge surface treatment method according to the present invention are explained in detail below.

First Embodiment

Figure 1:
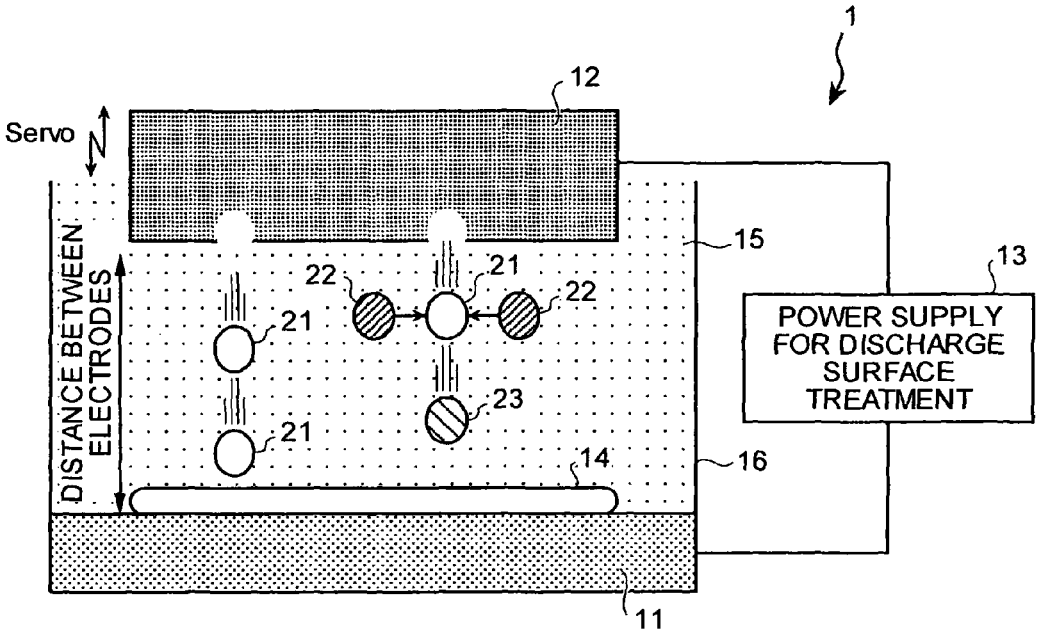
FIG. 1 is a schematic diagram of discharge surface treatment performed by a discharge surface treatment apparatus.

First, a discharge surface treatment method and an apparatus therefor used in the present invention are schematically explained. FIG. 1 is a diagram schematically showing discharge surface treatment in a discharge surface treatment apparatus. A discharge surface treatment apparatus 1 includes a work piece (hereinafter, "work") 11 on which a film 14 is formed, an electrode for discharge surface treatment 12 for forming the film 14 on the surface of the work 11, and a power supply for discharge surface treatment that supplies a voltage to both the work 11 and the electrode for discharge surface treatment 12 to cause arc discharge between both the work 11 and the electrode for discharge surface treatment 12 electrically connected. When the discharge surface treatment is performed in a liquid, a work tank is further provided and the work 11 and a portion of the electrode for discharge surface treatment 12 opposed to the work 11 are filled with a machining fluid 15 such as oil. When the discharge surface treatment is performed in the air, the work 11 and the electrode for discharge surface treatment 12 are placed in a treatment atmosphere. Note that, in an example shown in FIG. 1 and explained below, the discharge surface treatment is performed in a machining fluid. In the following explanation, the electrode for discharge surface treatment is simply called an "electrode". Moreover, in the following explanation, a distance between opposed surfaces of the electrode for discharge surface treatment 12 and the work 11 is referred to as a distance between electrodes.

A discharge surface treatment method in the discharge surface treatment apparatus 1 having such a constitution is explained below. The discharge surface treatment is performed by, for example, with the work 11 on which the film 14 is desired to be formed set as an anode and the electrode for discharge surface treatment 12, which is obtained by molding powder with an average particle diameter of 10 nanometers to several micrometers such as metal and ceramics, serving as a supply source of the film 14 set as a cathode, causing electric discharge between the anode and the cathode while controlling the distance between electrodes with a not-shown control mechanism to prevent both the electrodes from coming into contact with each other in the machining fluid 15.

When electric discharge occurs between the electrode for discharge surface treatment 12 and the work 11, part of the work and the electrode 12 melt by the heat generated due to the electric discharge. When a binding force among particles of the electrode 12 is weak, a part (hereinafter, electrode particles) 21 of the electrode 12 melted is separated from the electrode 12 by air blast and a static electric force caused by the electric discharge and moves to the surface of the work 11. When the electrode particles 21 reach the surface of the work 11, the electrode particles 21 solidify again and change to the film 14. A part of the electrode particles 21 reacting with components 22 in the machining fluid 15 or the air also forms the film 14 on the surface of the work 11. In this way, the film 14 is formed on the surface of the work 11. However, when a binding force among particles of the electrode 12 is strong, the electrode 12 is not stripped off by air blast and a static electrical force due to the electric discharge. Thus, it is impossible to supply an electrode material to the work 11. In other words, possibility of formation of a thick film according to the discharge surface treatment is affected by supply of a material from the electrode 12 side, melting of the material supplied on the surface of the work 11 and a way of bonding of the material with the material of the work 11. Hardness of the electrode 12 affects the supply of an electrode material.

Figure 2:
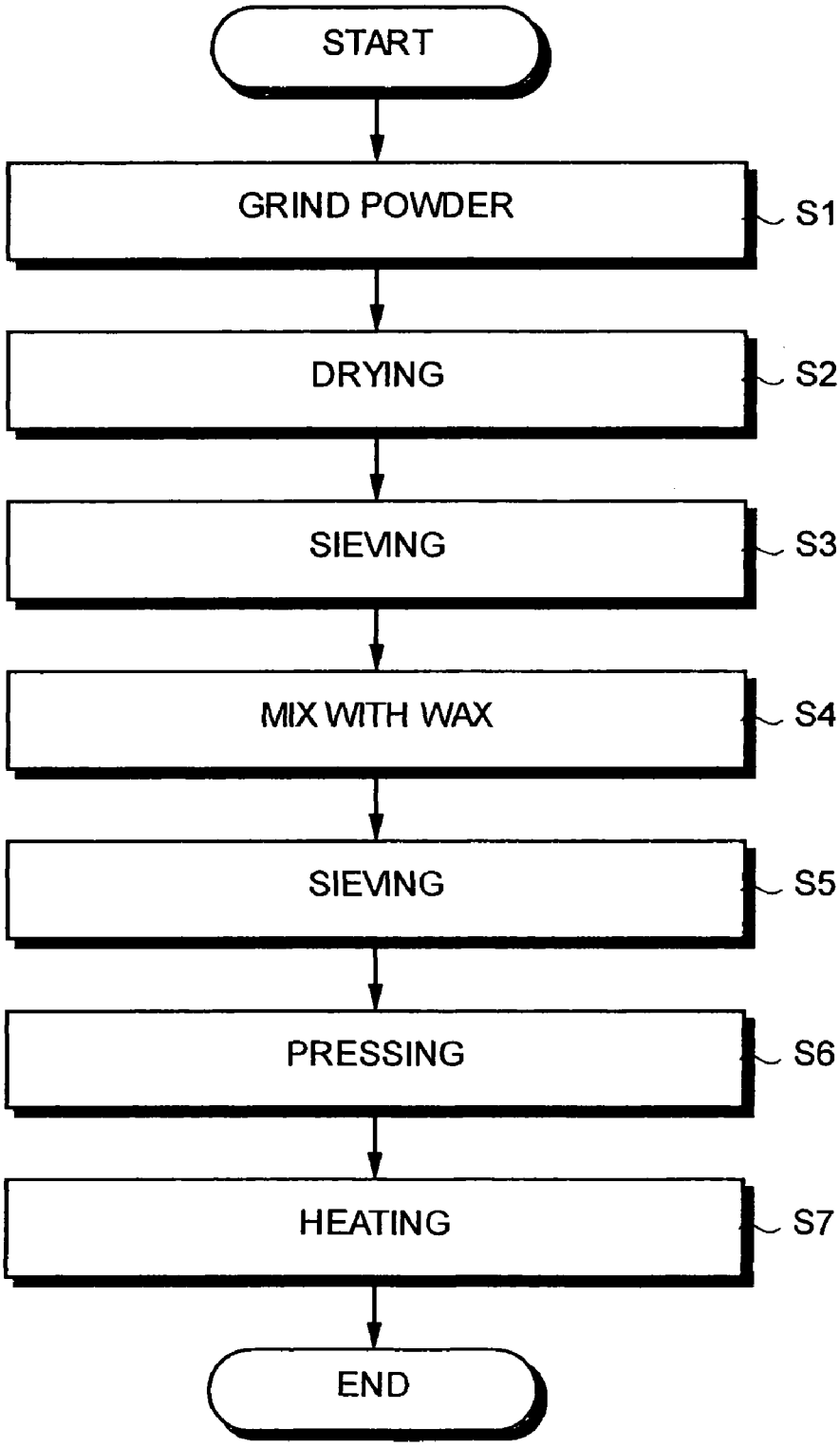
FIG. 2 is a flowchart of a process for manufacturing an electrode to be used in discharge surface treatment.

An example of a method of manufacturing the electrode for discharge surface treatment 12 used for the discharge surface treatment is explained. FIG. 2 is a flowchart of a process for manufacturing an electrode to be used in discharge surface treatment. First, powder of metal, ceramics, or the like having a component of the film 14 desired to be formed on the work 11 is ground (step S1). When the film 14 consists of a plurality of components, powders of the respective components are mixed and ground such that a desired ratio of the components is obtained. For example, spherical powder of metal, ceramics, or the like with an average particle diameter of several tens micrometers circulated in the market is ground into powder with an average particle diameter not more than 3 micrometers by a grinder like a ball mill apparatus. The grinding may be performed in a liquid. However, in this case, the liquid is evaporated to dry the powder (step S2). In the powder after drying, particles are aggregated with each other to form a large mass, and the large mass is taken apart into pieces and sieved to sufficiently mix a wax used at the next step and the powder (step S3). For example, when a ceramic sphere or a metal sphere is placed on a net of a sieve, on which the aggregated powder remain, and the net is vibrated, the mass formed by aggregation is taken apart by energy of the vibration and collision with the sphere and passes through meshes of the net. Only the powder passing through the meshes of the net is used at a step described below.

The process of sieving performed at step S3 is explained in detail below. In the discharge surface treatment, a voltage applied between the electrode for discharge surface treatment 12 and the work 11 to cause electric discharge is usually in a range of 80 volts to 400 volts. When a voltage in this range is applied between the electrode 12 and the work 11, a distance between the electrode 12 and the work 11 during the discharge surface treatment is set to about 0.3 millimeter. As described above, it can be surmised that, in the discharge surface treatment, the aggregated mass forming the electrode 12 may leave the electrode 12 because of arc discharge caused between both the electrodes while keeping a size of the mass. If the size of the mass is not more than the distance between electrodes (not more than 0.3 millimeter), it is possible to cause the next electric discharge even if the mass is present between the electrodes. Since electric discharge occurs in places in a short distance from each other, it is considered that electric discharge occurs in a place where the mass is present and it is possible to crash the mass into small pieces with thermal energy and an explosive force of the electric discharge.

However, when the size of the mass forming the electrode 12 is equal to or larger than the distance between electrodes (equal to or larger than 0.3 millimeter), the mass leaves from the electrode 12 because of electric discharge while keeping the size and is deposited on the work 11 or drifts in an interelectrode space filled with the machining fluid 15 between the electrode 12 and the work 11. When the large mass is deposited, since electric discharge occurs in a place where a distance between the electrode and the work 11 is small, electric discharge concentrates in that place and cannot be caused in other places. Thus, it is impossible to uniformly deposit the film 14 on the surface of the work 11. Since the large mass is too large, it is impossible to completely melt the mass with heat of the electric discharge. Thus, the film 14 is so fragile as to be shaved by a hand. When the large mass drifts in the interelectrode space, the electrode 12 and the work 11 are short-circuited so that an electric discharge does not occur. In other words, to uniformly form the film 14 and obtain stable electric discharge, a mass equal to or larger than a distance between electrodes, which is formed by aggregation of powder, must not be present in the powder forming the electrode. The aggregation of the powder is likely to occur in the case of metal powder and conductive ceramics and is less likely to occur in the case of nonconductive powder. The aggregation of the powder is more likely to occur as an average particle diameter of the powder is reduced. Therefore, to prevent a harmful effect during the discharge surface treatment due to a mass generated by such aggregation of the powder, a step of sieving the aggregated powder at step S3 is required. To that effect, in sieving the powder, it is necessary to use meshes of a net smaller than the distance between electrodes.

Thereafter, to make transmission of a pressure of press to the inside of the powder better in the case of press at a later step, wax like paraffin is mixed at a weight ratio of 1% to 10% as required (step S4). When the powder and the wax are mixed, although it is possible to improve moldability, since the periphery of the powder is covered with a liquid again, the powder is aggregated by an intermolecular force of the powder and a static electrical force to form a large mass. Thus, the mass aggregated is sieved again to be taken apart into pieces (step S5). A way of sieving is the same as the method at step S3 described above.

Figure 3:
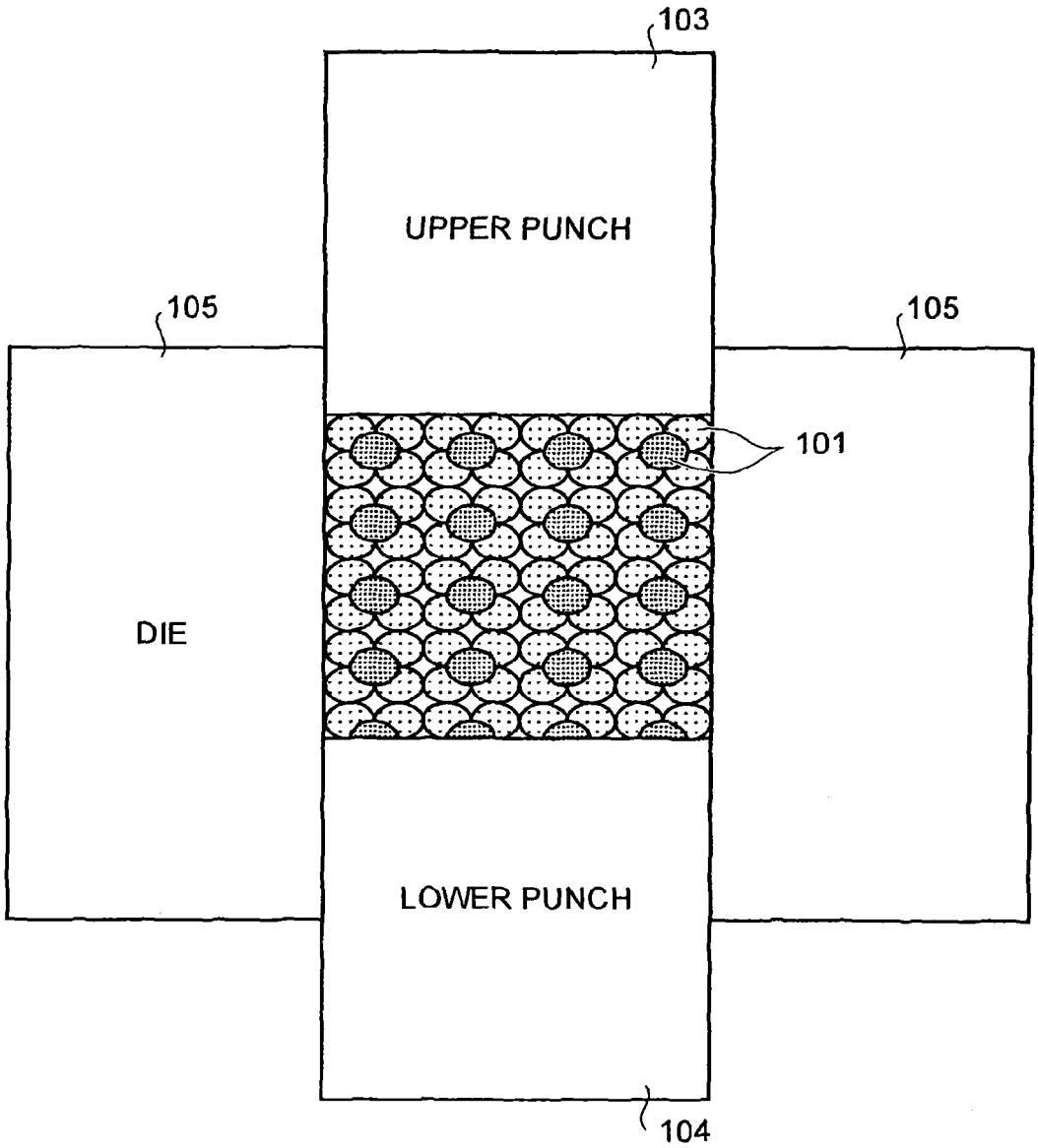
FIG. 3 is a schematic sectional view of a state of a molding device at the time when powder is molded.

Subsequently, powder obtained at step S5 is molded by a compression press (step S6). FIG. 3 is a schematic sectional view of a state of a molding device at the time when powder is molded. A lower punch 104 is inserted from a bottom of a hole formed in a die 105. Powder (a mixture of the powders when the powders consist of a plurality of components) sieved at step S5 is filled in a space formed by the lower punch 104 and the die 105. Thereafter, an upper punch 103 is inserted from a top of the hole formed in the die 105. Pressure is applied from both sides of the upper punch 103 and the lower punch 104 of the molding device filled with such powder 101 by a pressurizer or the like to compression-mold the powder 101. In the following explanation, the powder 101 compression-molded is referred to a green compact. In this case, the electrode 12 is hardened when a press pressure is increased. The electrode 12 is softened when the press pressure is decreased. The electrode 12 is hardened when a particle diameter of the powder 101 of the electrode material is small. The electrode 12 is softened when a particle diameter of the powder 101 is large.

Thereafter, the green compact is taken out from the molding device and heated in a vacuum furnace or a furnace of a nitrogen atmosphere (step S7). In the case of heating, the electrode 12 is hardened when a heating temperature is raised and the electrode 12 is softened when a heating temperature is lowered. It is also possible to lower an electric resistance of the electrode 12 by heating the green compact. Therefore, it is meaningful to heat the green compact even when the powder is compression-molded without mixing wax in the powder at step S4. Consequently, bonding among the powders in the green compact progresses and the electrode for discharge surface treatment 12 having electrical conductivity is manufactured.

Note that, even when the grinding step at step S1 is omitted, that is, when the powder with the average particle diameters of several tens micrometers is directly used, or when the sieving step at step S3 is omitted and the large mass equal to or larger than 0.3 millimeter is mixed, it is possible to mold the electrode for discharge surface treatment 12. However, there is a problem in that the electrode 12 has fluctuation in hardness, that is, hardness on the surface is slightly high and hardness in the center is low.

Powder with an average diameter not more than 3 micrometers of Co or Ni (Nickel), which is less easily oxidized, an alloy or oxide of Co and Ni, or ceramics are often circulated in the market. Thus, when such powder is used, it is possible to omit the grinding step at step S1 and the drying step at step S2.

Specific embodiments of the electrode for discharge surface treatment manufactured by the method described above are explained. In the first embodiment, when an average particle diameter of powder forming an electrode is 5 micrometers to 10 micrometers, a relation among a ratio of a material not forming carbide or a material less easily forming carbide, hardness of the electrode, and thickness of a film formed by the electrode is explained.

In the first embodiment, a result of testing, concerning an electrode for discharge surface treatment with a component of the material not forming carbide or a material less easily forming carbide changed, changes in hardness of the electrode and thickens of a film formed on a work piece by the discharge surface treatment method is described below. A material forming a basis of the electrode for discharge surface treatment used for the test was $Cr_3C_2$ (chromium carbide) powder. Co powder was added to the $Cr_3C_2$ powder as the material not forming carbide or the material less easily forming carbide. A volume of Co to be added was changed between 0% and 80% and hardness of the electrode for discharge surface treatment to be tested was set to predetermined hardness. Note that the electrode was manufactured from the $Cr_3C_2$ powder with a particle diameter of 5 micrometers and the Co powder with a particle diameter of 5 micrometers according to the flowchart in FIG. 2. At the grinding step of grinding powder at step S1, grinding was performed under a condition for obtaining powder with a particle diameter of 5 micrometers. At the mixing step of mixing powder with wax at step S4, wax with 2 to 3 weight percent was mixed. At the pressing step at step S6, the powder was compression-molded at a press pressure of about 100 MPa. At heating step at step S7, a heating temperature was changed in a range of 400° C. to 800° C. The heating temperature was set higher as a ratio of the $Cr_3C_2$ powder was larger and was set lower as a ratio of the Co powder was larger. This is because, whereas a manufactured electrode tended to be fragile and easily crumbled when heated at low temperature when the ratio of the $Cr_3C_2$ powder was larger, strength of the electrode was high even if a heating temperature was low when the ratio of the Co powder was larger.

Note that a volume ratio (a volume percent) used in this specification refers to a ratio of a value obtained by dividing a weight percent of each of materials mixed by density of each of the materials. Specifically, when a plurality of materials are mixed, the volume ratio is a ratio of volumes of the materials. When a material is an alloy, a ratio of a value obtained by dividing a weight percent of each of materials (metal elements) contained in the alloy by density (specific gravity) of each of the materials is set as the volume percent. In other words, the volume percent is a value obtained by dividing a value, which is obtained by dividing a weight percent of a target component by density of the component, by a value obtained by adding up values obtained by dividing weight percents of respective components used in the electrode for discharge surface treatment by densities of the components. For example, a volume ratio (a volume percent) of Co powder in a mixture of the $Cr_3C_2$ powder and the Co powder is represented as the following expression.

$$\text{Volume \% of Co} = \text{Weight \% of Co}/\text{Density of Co}/(\text{Weight \% of } Cr_3C_2/\text{Density of } Cr_3C_2 + \text{Weight \% of Co}/\text{Density of Co})$$

From this expression, it goes without saying that, when original specific gravities of materials mixed as an alloy are close, volume percents of the materials are substantially the same as weight percents thereof.

Figure 4A:
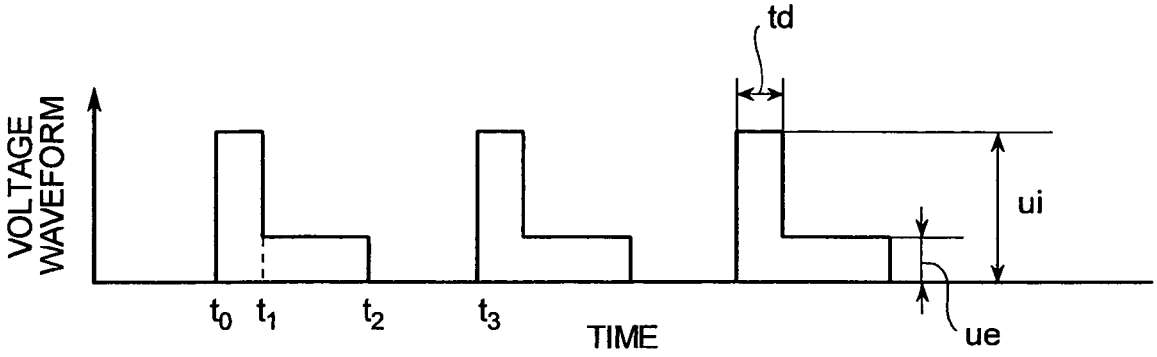
FIG. 4A is a graph of a voltage waveform of a voltage applied between an electrode for discharge surface treatment and a work at the time of electric discharge.
Figure 4B:
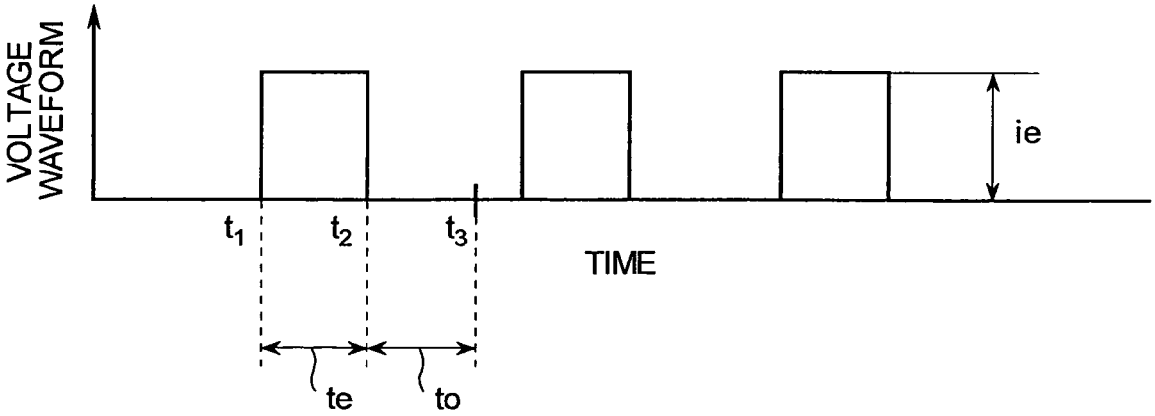
FIG. 4B is a graph of a current waveform of a current flowing in the discharge surface treatment apparatus at the time of electric discharge.

Discharge pulse conditions at the time of the discharge surface treatment in the first embodiment are explained. FIGS. 4A and 4B are diagrams showing an example of discharge pulse conditions at the time of the discharge surface treatment. FIG. 4A shows a voltage waveform of a voltage applied between an electrode for discharge surface treatment and a work at the time of electric discharge. FIG. 4B shows a current waveform of a current flowing to a discharge surface treatment apparatus at the time of electric discharge. As shown in FIG. 4A, a no-load voltage ui is applied between both the electrodes at time $t_0$. A current starts flowing between both the electrodes at time $t_1$ after elapse of discharge delay time td and electric discharge starts. The voltage at this point is a discharge voltage ue and the current flowing at this point has a peak current value ie. When supply of the voltage between both the electrodes is stopped at time $t_2$, the current stops flowing. In other words, the electric discharge stops. In this case, t2−t1 refers to as a pulse width te. A voltage with a voltage waveform at time t0 to t2 is repeatedly applied between both the electrodes at intervals of a quiescent time to. As shown in FIG. 4A, a pulsed voltage is applied between the electrode for discharge surface treatment 12 and the work 11. In this example, as the discharge pulse conditions used at the time of the discharge surface treatment, the peak current ie was set to 10 amperes, the discharge duration (the discharge pulse width) te was set to 64 microseconds, the quiescent time was set to 128 microseconds. In the test, the discharge surface treatment was applied to the work 11 for fifteen minutes using an electrode with an area 15 mm×15 mm.

Figure 5:
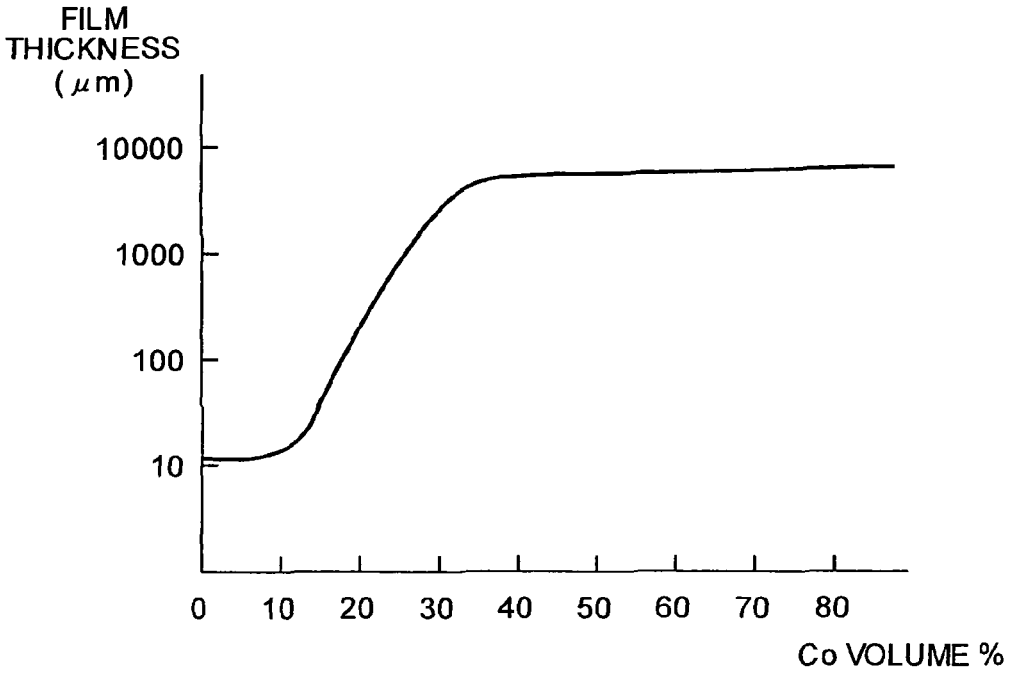
FIG. 5 is a graph of a relation between an amount of Co and a film thickness according to a change in the amount of Co in an electrode for discharge surface treatment manufactured by changing an amount of Co powder mixed in $Cr_3C_2$ powder.

FIG. 5 is a graph of a relation between an amount of Co and a film thickness according to a change in the amount of Co in an electrode for discharge surface treatment manufactured by changing an amount of the Co powder forming carbide less easily mixed in the $Cr_3C_2$ powder that is carbide. In FIG. 5, an abscissa indicates a volume percentage of Co contained in the electrode for discharge surface treatment and an ordinate indicates thickness (μm) of a film formed on a work piece in a logarithmic scale.

When a film is formed based on the discharge pulse conditions, thickness of a film formed on a work differs depending on a volume percent of Co contained in a manufactured electrode. According to FIG. 5, thickness of about 10 micrometers at the Co content not more than 10 volume percent gradually increases from the Co content of about 30 volume percent. When the Co content exceeds about 40 volume percent, the thickness increases to near 10,000 micrometers.

More specifically, when a film is formed on a work based on the conditions described above, when the Co content in the electrode is 0 volume percent, that is, when the $Cr_3C_2$ powder has 100 volume percent, a limit of thickness of a film that can be formed is about 10 micrometers. It is impossible to increase the thickness more.

Figure 6:
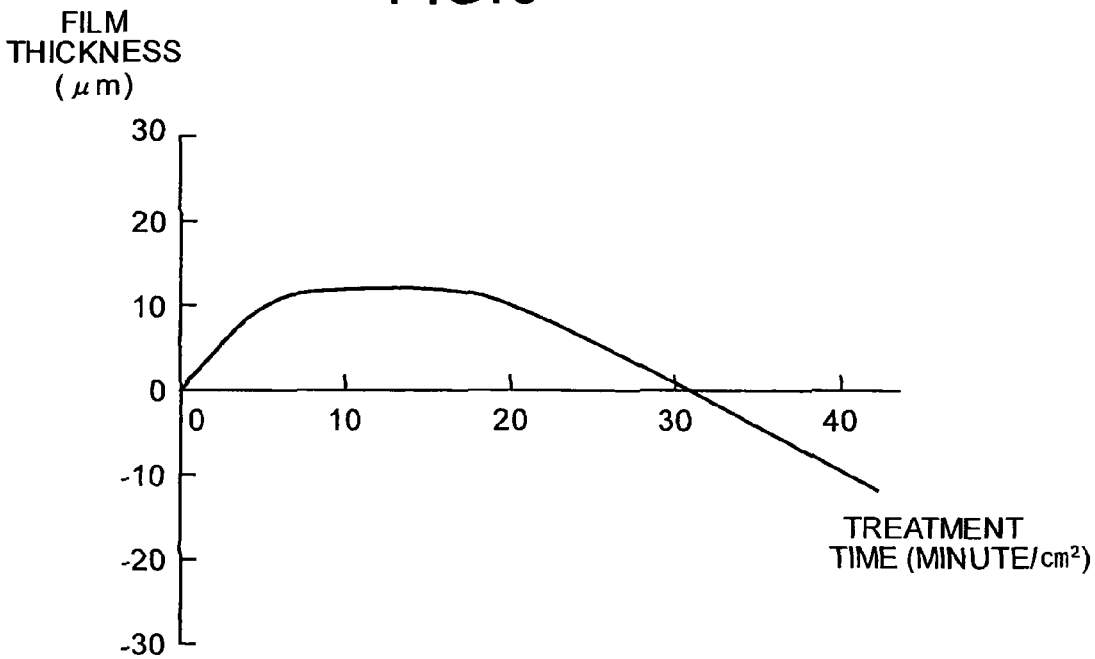
FIG. 6 is a graph of a state of formation of a film with respect to a machining time at the time when a material not forming carbide or a material less easily forming carbide is not contained in an electrode for discharge surface treatment.

FIG. 6 is a graph of a state of formation of a film with respect to a machining time at the time when a material not forming carbide or a material less easily forming carbide is not contained in an electrode for discharge surface treatment. In FIG. 6, an abscissa indicates a machining time (minute/$cm^2$) for performing discharge surface treatment per a unit area and an ordinate indicates thickness of a film (a surface position on a work) (μm) with a position of a surface of a work before performing discharge surface treatment as a reference. As shown in FIG. 6, at an initial stage of the discharge surface treatment, the film grows to be thick as time passes. However, the growth is saturated at a certain point (about 5 minutes/$cm^2$). Thereafter, the thickness of the film does not increase for a while. However, when the discharge surface treatment is continued for certain time or more (about 20 minutes/$cm^2$), the thickness of the film starts decreasing. Finally, the thickness of the film decreases to be smaller than zero. The discharge surface treatment changes to digging, that is, removal machining. However, even in a state in which the discharge surface treatment changes to the removal machining, actually, the film on the work is still present and has thickness of about 10 micrometers. In other words, the thickness of the film changes less easily from a state in which the film is treated at appropriate time (while a machining time is 5 minutes/$cm^2$ to 20 minutes/$cm^2$). From such a result, it is considered that a machining time is appropriate from 5 minutes to 20 minutes.

Referring back to FIG. 5, it is possible to increase the thickness of the film as an amount of Co, which is a material less easily forming carbide in the electrode, is increased. When the Co content in the electrode exceeds 30 volume percent, thickness of a film formed starts increasing. When the Co content exceeds 40 volume percent, a thick film is easily formed stably. In FIG. 6, the film thickness gently increases from the Co content of about 30 volume percent. This is an average value obtained by performing the test a plurality of times. Actually, when the Co content is about 30 volume percent, the formation of the film was unstable, for example, the film was not built up thick or, even if the film was built up thick, strength of the film was low, that is, the film was removed when the film was rubbed strongly with a metal piece. Therefore, it is preferable that the Co content is equal to or higher than 40 volume percent.

In this way, it is possible to form a film containing a metal component not forming carbide and form a thick film stably by increasing a quantity of materials remaining as metal in the film.

Figure 7:
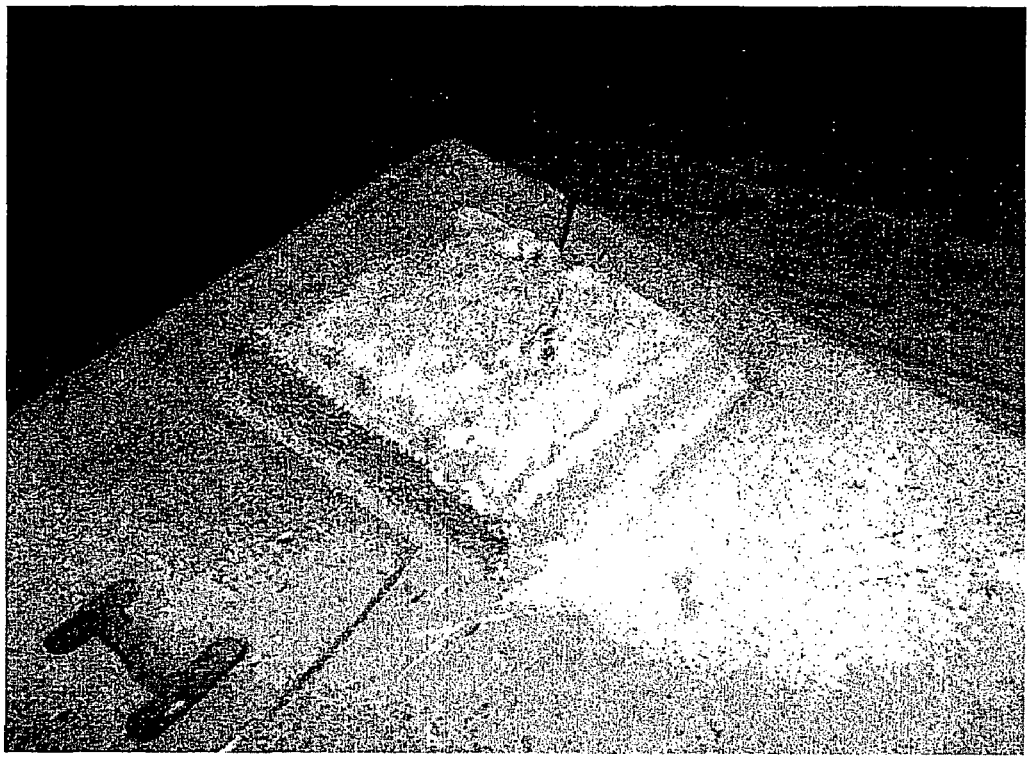
FIG. 7 is a photograph of a film that is formed when discharge surface treatment is performed using an electrode with a Co content of 70 volume percent.

FIG. 7 is a photograph of a film that is formed when the discharge surface treatment is performed using an electrode with a Co content of 70 volume percent. The photograph illustrates formation of a thick film. A thick film with thickness of about 2 millimeters is formed. The film is formed at a machining time of fifteen minutes. However, it is possible to form a thicker film if the machining time is increased.

In this way, it is possible to stably form a thick film on a surface of a work according to the discharge surface treatment by using an electrode containing 40 volume percent or more of the material less easily forming carbide such as Co or the material not forming carbide in an electrode.

In the explanation of the example described above, Co was used as the material less easily forming carbide. The same results could be obtained when Ni, Fe (iron), Al (aluminum), Cu (copper), and Zn (zinc) were used.

Note that the thick film in this context refers to a dense film having metallic luster inside a structure thereof (since the thick film is a film formed by pulsed discharge, a top surface of the film has poor surface roughness and looks as if the film does not have luster). For example, even when a content of the material less easily forming carbide such as Co is small, a deposit on a work is built up if strength (hardness) of an electrode is decreased. However, the deposit is not a dense film and can be easily removed when the deposit is rubbed with a metal piece or the like. Such a film is not called a thick film in the present invention. Similarly, the deposit layer described in the Patent Document 1 and the like is such a film that is not dense and can be easily removed when the film is rubbed with a metal piece or the like. Thus, such a film is not called a thick film in the present invention.

In the above explanation, the $Cr_3C_2$ powder and the Co powder are compression-molded and then heated to manufacture an electrode. However, a compression-molded green compact may be directly used as an electrode. However, to form a dense film, it is not preferable that an electrode is too hard or too soft and appropriate hardness is required. Thus, in general, heat treatment is necessary. Heating of a green compact leads to maintenance of molding and solidification.

The hardness of an electrode has a correlation with strength of bonding of powders of an electrode material and relates to an amount of supply of the electrode material to a work side by electric discharge. When the hardness of the electrode is high, since bonding of the electrode material is strong, only a small quantity of electrode materials are discharged even if electric discharge occurs. Thus, it is impossible to perform sufficient film formation. Conversely, when the hardness of the electrode is low, since bonding of the electrode materials is weak, a large quantity of materials are supplied when electric discharge occurs. When the quantity is too large, it is impossible to sufficiently melt the materials with energy of a discharge pulse. Thus, it is impossible to form a dense film.

When powder made of the same material and having the same particle diameter is used, parameters affecting hardness of an electrode, that is, a bonding state of materials of the electrode are a press pressure and a heating temperature. In the first embodiment, as an example of the press pressure, a press pressure of about 100 MPa is used. However, if the press pressure is further increased, the same hardness is obtained even if the heating temperature is lowered. Conversely, when the press pressure is lowered, it is necessary to set the heating temperature higher.

In the first embodiment, a result of a test under one condition as an example of a pulse discharge condition at the time of the discharge surface treatment is described. However, it goes without saying that the same result is obtained under other conditions such as thickness of a film.

As described above, it is seen that a condition in terms of a material is important for forming a thick film. However, it has been found that, in the case of the discharge surface treatment, in particular, thick film formation, other conditions are also extremely important. Usually, the electrode for discharge surface treatment is manufactured by compression-molding and heating a powder material according to the flowchart in FIG. 2. In that case, in general, a state of the electrode often depends on a press pressure at the time of compression molding and a heating temperature at the time of heat treatment. Conventionally, as management of a state of an electrode, film formation is performed using an electrode molded under predetermined conditions such as a press pressure and a heating temperature and the state of the electrode is judged according to a state of the film formation. However, with this method, a film has to be formed for management of a state of an electrode. This takes a lot of time and labor. Thus, the inventors studied methods for (1) an electric resistance of an electrode, (2) a bending test for an electrode, and (3) a hardness test for an electrode as a method of managing a state of an electrode.

First, the electric resistance in (1) is a method of slicing an electrode for discharge surface treatment into a predetermined shape and measuring an electric resistance. The electric resistance tends to be smaller as the electrode for discharge surface treatment is solidified more firmly. Although the electric resistance is a good index for strength of the electrode for discharge surface treatment, there are problems in that, for example, fluctuation tends to occur in measurement and, since the electric resistance is affected by a physical property value of a material and different values are obtained when different materials are used, a value in an optimum state has to be grasped for each different material.

The bending test in (2) is a method of slicing an electrode for discharge surface treatment into a predetermined shape, performing a three-point bending test, and measuring a resistance force against bending. This method has problems in that, for example, fluctuation tends to occur in measurement and measurement is costly.

As the hardness test in (3), there are a method of pressing an indenter against an electrode for discharge surface treatment and measuring hardness according to a shape of an impression, a method of scratching an electrode for discharge surface treatment with a gauge head like a pencil and judging whether the electrode is scraped, and the like.

It has been found that, although these three methods have a strong correlation, the method of judging a state of an electrode for discharge surface treatment according to the hardness test using a gauge head such as a pencil in (3) is most suitable because of simplicity of measurement and the like. Thus, a relation between hardness of an electrode and a characteristic of a film formed by the electrode is explained below. Note that, as an index used as a reference for hardness of the electrode, a pencil scratch test for a coating film in JIS K 5600-5-4 was used when a particle diameter of powder forming the electrode was large and the electrode was soft and Rockwell hardness was used when a particle diameter of powder forming the electrode was small and the electrode was hard. The standard of JIS K 5600-5-4 is originally used for evaluation of a coating film and is very convenient in evaluation of a material with low hardness. It goes without saying that, since it is possible to convert results of the other hardness evaluation methods and a result of the pencil scratch test for a coating film, the other hardness evaluation methods may be used as an index.

Figure 8:
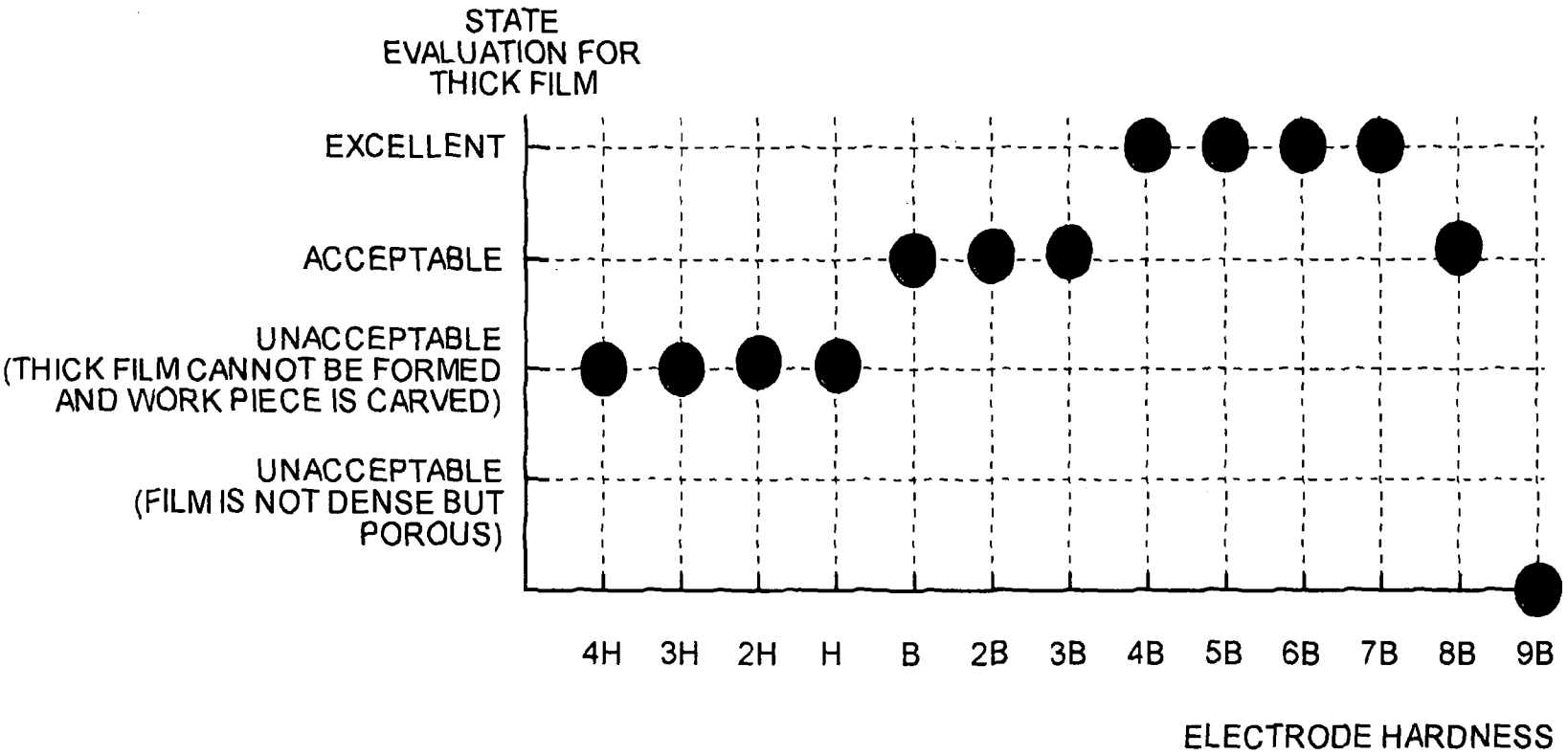
FIG. 8 is a graph of a state of thick film formation at the time when hardness of an electrode for discharge surface treatment with a volume ratio of $Cr_3C_2$ 30%-Co 70% is changed.

As described above, a condition in terms of a material is important to form a thick film. However, according to the experiment, in the case of thick film formation, other conditions, in particular, hardness of an electrode is also extremely important. A relation between formation of a thick film according to the discharge surface treatment and hardness of an electrode for discharge surface treatment is explained with an electrode for discharge surface treatment manufactured at a volume ratio of $Cr_3C_2$ 30%-Co 70% as an example. FIG. 8 is a graph of a state of thick film formation at the time when hardness of an electrode for discharge surface treatment with a volume ratio of $Cr_3C_2$ 30%-Co 70% is changed. In FIG. 8, an abscissa indicates hardness of the electrode for discharge surface treatment measured according to hardness of a pencil for a coating film used for the evaluation of hardness. The hardness is higher to the left and lower to the right on the abscissa. An ordinate indicates an evaluation state of thickness of a film formed by the electrode for discharge surface treatment. As discharge pulse conditions used at the time of the discharge surface treatment in performing this evaluation test, the peak current value ie is 10 amperes, the discharge duration (discharge pulse time) te is 64 microseconds, and the quiescent time to is 128 microseconds. In the evaluation test, a film was formed using an electrode with an area of 15 mm×15 mm.

As shown in FIG. 8, a state of a film was excellent when the hardness of the electrode for discharge surface treatment is hardness of 4B to 7B and a dense thick film was formed. A satisfactory thick film is also formed with the hardness of the electrode for discharge surface treatment between B to 4B. However, formation speed of a film tends to be lower as the hardness increases. Formation of a thick film is rather difficult at hardness of B. When the hardness is higher than B it is impossible to form a thick film. Thus, as the hardness of the electrode for discharge surface treatment increases, a work piece (a work) is machined while being removed.

On the other hand, it is also possible to form a satisfactory thick film when the hardness of the electrode for discharge surface treatment is 8B. However, according to an analysis of a structure, vacancies tend to gradually increase in the film. When the hardness of the electrode for discharge surface treatment is lower than 9B, a phenomenon in which an electrode component is deposited on a work piece while not being melted sufficiently is observed. The film is not dense but porous. Note that the relation between hardness of an electrode for discharge surface treatment and a state of a film also slightly changes depending on discharge pulse conditions used. When appropriate discharge pulse conditions are used, it is possible to expand a range in which a satisfactory film can be formed to some extent. The tendency described above was confirmed for electrodes manufactured from powder with an average particle diameter of 5 micrometers to 10 micrometers regardless of materials forming the electrode.

According to the first embodiment, there is an effect that it is possible to stably form a thick film on a work by adding 40 volume percent or more of a material not forming carbide such as Co, Ni, Fe, Al, Cu, or Zn or a material less easily forming carbide in a material of powder with a particle diameter of 5 micrometers to 10 micrometers forming an electrode for discharge surface treatment, manufacturing an electrode for discharge surface treatment to have hardness between B to 8B, preferably, 4B to 7B in hardness according to the pencil scratch test for a coating film, and performing the discharge surface treatment using the electrode for discharge surface treatment. By using the electrode for discharge surface treatment, it is possible to substitute the discharge surface treatment for the machining of welding and thermal spraying and automate the machining conventionally performed by thermal spraying and welding.

Second Embodiment

In the discharge surface treatment, it depends on bonding strength of powders forming an electrode whether an electrode material is discharged from the electrode by electric discharge. In other words, if the bonding strength is high, the powder is discharged less easily by energy of the electric discharge and, if the bonding strength is low, the powder is easily discharged. The bonding strength differs depending on a size of powder forming the electrode. For example, when a particle diameter of the powder forming the electrode is large, since the number of points where powders are bonded with one another in the electrode decreases, electrode strength decreases. When a particle diameter of the powder forming the electrode is small, since the number of points where powders are bonded with one another in the electrode increases, electrode strength increases. Therefore, it depends on a size of a particle diameter of the powder whether the electrode material is discharged from the electrode by electric discharge. In the first embodiment described above, when the powder with a particle diameter of about 5 micrometers to 10 micrometers is used, hardness of B to 8B in hardness according to the pencil scratch test for a coating film is an optimum value. In the second embodiment, hardness of an electrode and thickness of a film at the time when a particle diameter is 1 micrometer to 5 micrometers are explained.

In an example explained in this embodiment, an electrode for discharge surface treatment is manufactured according to the flowchart in FIG. 2 in the first embodiment by grinding and mixing alloy powders containing components such as Co, Cr, and Ni at a predetermined ratio according to, for example, an atomizing method or milling (to have a particle diameter of about 3 micrometers). However, wax of 2 to 3 weight percent is mixed in the step of mixing with wax at step S4, powder in manufacturing an electrode is compression-molded at a press pressure of about 100 MPa at the pressing step at step S6, and a heating temperature is changed in a range of 600 to 800° C. at the heating step at step S7. Note that, in the manufacturing of an electrode, the heating step at step S7 may be omitted to use a green compact obtained by compression-molding mixed powder as an electrode. A composition of the alloy powder is 20 weight percent of Cr, 10 weight percent of Ni, 15 weight percent of W (tungsten), and 55 weight percent of Co. A volume percent of Co is equal to or larger than 40 percent.

As discharge pulse conditions in performing the discharge surface treatment using the electrode manufactured, in FIGS. 4A and 4B, the peak current value ie was set to 10 A, the discharge duration (the discharge pulse width) te was set to 64 microseconds, the quiescent time to was set to 128 microseconds. A film was formed using an electrode with an area of 15 mm×15 mm. As a result, although the electrode material was formed of powder, since the pulverized alloy was used, a quality of material was uniform and had no fluctuation. Thus, a high-quality film without fluctuation in components could be formed.

It goes without saying that it is possible to manufacture the same electrode when an electrode is manufactured by mixing powders of materials (Cr powder, Ni powder, W powder, and Co powder) weighed to obtain a predetermined composition. However, since there is a problem in that, for example, fluctuation in mixing of the powders occurs, it is inevitable that performance slightly falls.

In the above explanation, the material obtained by pulverizing the alloy with the ratio of 20 weight percent of Cr, 10 weight percent of Ni, 15 weight percent of W, and Co of the remaining weight percent was used. However, a composition of an alloy to be pulverized is not limited to this. Any alloy may be used as long as the alloy is an alloy containing 40 percent or more in volume percent of Co, Ni, Fe, Al, Cu, and Zn, which are elements less easily forming carbide, for example, an alloy with a ratio of 25 weight percent of Cr, 10 weight percent of Ni, 7 weight percent of W, and the remaining weight percent of Co, an alloy with a ratio of 28 weight percent of Mo, 17 weight percent of Cr, 3 weight percent of Si (silicon), and the remaining weight percent of Co, an alloy with a ratio of 15 weight percent of Cr, 8 weight percent of Fe, and the remaining weight percent of Ni, an alloy with a ratio of 21 weight percent of Cr, 9 weight percent of Mo, 4 weight percent of Ta (tantalum), and the remaining weight percent of Ni, and an alloy with a ratio of 19 weight percent of Cr, 53 weight percent of Ni, 3 weight percent of Mo, 5 weight percent of (Cd (cadmium)+Ta), 0.8 weight percent of Ti, 0.6 weight percent of Al, and the remaining weight percent of Fe.

However, characteristics such as hardness of a material differ when an alloy ratio of an alloy is different. Thus, there is a slight difference in moldability of an electrode and a state of a film. For example, when hardness of an electrode material is high, it is difficult to mold powder by a press. When strength of an electrode is increased by heat treatment, contrivance such as setting a heating temperature higher is necessary. For example, the alloy with a ratio of 25 weight percent of Cr, 10 weight percent of Ni, 7 weight percent of W, and the remaining weight percent of Co is relatively soft and the alloy with a ratio of 28 weight percent of Mo, 17 weight percent of Cr, 3 weight percent of Si, and the remaining weight percent of Co is relatively hard. In the heat treatment for the electrode for giving necessary hardness to the electrode, it is necessary to set a heating temperature about 100° C. higher in average for the latter alloy than the former alloy.

As described in the first embodiment, a thick film is formed more easily as an amount of metal contained in a film increases. A dense thick film is formed more easily when Co, Ni, Fe, Al, Cu, and Zn, which are materials less easily forming carbide, are contained more as materials contained alloy powders that are components of an electrode.

When tests were carried out using various alloy powders, as in the first embodiment, it was made clear that a thick film was stably formed easily when a content of a material less easily forming carbide or a material not forming carbide in an electrode exceeded 40 volume percent. It was made clear that a content of Co in an electrode preferably exceeded 50 volume percent because a thick film with sufficient thickness could be formed.

Even if a material mixed as a component of an alloy other than Co, Ni, Fe, Al, Cu, and Zn, which are materials less easily forming carbide, is a material forming carbide, when the material is a material less easily forming carbide relatively in the materials contained, a metal component other than Co, Ni, Fe, Al, Cu, and Zn is contained in a film. Thus, it is possible to form a dense film even if a ratio of Co, Ni, Fe, Al, Cu, and Zn is lower.

It was made clear that, in the case of an alloy consisting of two elements, Cr and Co, it was easy to form a thick film when a content of Co in an electrode exceeds 20 volume percent. Cr is a material forming a carbide but is material less easily forming carbide compared with an active material such as Ti. In other words, Cr is a material easily carbonized but is less easily carbonized compared with the material such as Ti. When Cr is contained in an electrode, a part of Cr changes to carbide and another part thereof changes to a film while keeping a state of metal Cr. From the result described above, it is considered that a ratio of materials remaining as metal in a film is required to be equal to or larger than about 30 percent as a volume to form a dense thick film.

A result obtained by investigating, when a film is formed using an electrode manufactured from powder with a particle diameter of 1 micrometer to 5 micrometers, a relation between hardness of the electrode and thickness of the film is described below. Note that, when an electrode is manufactured from powder with a particle diameter of about 6 micrometers, it is possible to use the pencil scratch test for a coating film defined in JIS K 5600-5-4. However, when an electrode is manufactured from powder with a particle diameter smaller than that, it is impossible to use the test. Thus, in this example, an index of hardness $H=100-1000\times h$ calculated from a press-in distance h (μm) at the time when a steel ball with a diameter of ¼ inch is pressed against an electrode at 15 kgf is used.

As a result, when hardness of an electrode was in a range of about 25 to 35, a state of a film was the best and a dense thick film could be formed. However, it is possible to form a thick film in a range of hardness slightly shifted from the range. It is possible to form a thick film when the electrode has highest hardness of about 50 and when the electrode has lowest hardness of about 20. However, formation speed of a film tends to fall as the electrode becomes harder. It is relatively difficult to form a thin film at hardness of about 50. When the electrode is harder, it is impossible to form a thick film. As the electrode becomes harder, a work piece is machined to be removed. When the electrode is soft, it is possible to form a thick film at hardness as low as about 20. However, a quantity of materials not melted tends to increase. When hardness of the electrode is lower than about 20, a phenomenon in which an electrode component is deposited on the work piece side while not being sufficiently melted is observed. Note that the relation between hardness of the electrode and a state of the film also slightly changes depending on discharge pulse conditions used. When appropriate discharge pulse conditions are used, it is possible to expand a range in which a satisfactory film can be formed to some extent.

Note that, as in the second embodiment, when a particle diameter of powder is about 3 micrometers (about 1 micrometer to 5 micrometers), hardness of an electrode appropriate for the discharge surface treatment also increases. It is difficult to measure hardness with the pencil scratch test for a coating film in JIS K 5600-5-4 described in the first embodiment. Thus, in this embodiment, a Rockwell hardness test is used. The Rockwell hardness test is a test for pressing a ball against an electrode at a predetermined load and calculating hardness from a shape of an impression of the ball. Since the electrode is broken when a load is too high, it is necessary to set the load to appropriate strength. Besides, there are a Vickers hardness test and the like. Although it is naturally possible to measure hardness of an electrode with the hardness tests, there is a problem in that it is hard to see results of the tests because, for example, an end of an impression collapses. It can be said that an indenter shape is more desirable when a ball is used.

According to the second embodiment, it is possible to form a dense thick film on a surface of a work by manufacturing an electrode for discharge surface treatment to have hardness of 20 to 50 from powder containing 40 volume percent or more of the material not forming carbide or the material less easily forming carbide and having an average particle diameters of 1 micrometer to 5 micrometers, and performing the discharge surface treatment using the electrode.

Third Embodiment

An electrode was manufactured from the powder of the same material as the second embodiment with an average particle diameter set to 1 micrometer. Despite the fact that the identical material is used, hardness of an electrode appropriate for the discharge surface treatment could be further increased by reducing the particle diameter of the powder. In this case, again, a thick film was stably formed easily when 40 volume percent or more of a material not forming carbide or a material less easily forming carbide is contained.

In this case, when hardness of an electrode was in a range of about 30 to 50, a state of a film was the best and a dense thick film could be formed. However, it is possible to form a thick film in a range of hardness slightly shifted from the range. It is possible to form a thick film when the electrode has highest hardness of about 60 and when the electrode has lowest hardness of about 25. However, formation speed of a film tends to fall as the electrode becomes harder. It is relatively difficult to form a thin film at hardness of about 60. When the electrode is harder, it is impossible to form a thick film. As the electrode becomes harder, a work piece is machined to be removed. When the electrode is soft, it is possible to form a thick film at hardness as low as about 25. However, a quantity of materials not melted tends to increase. When hardness of the electrode is lower than about 25, a phenomenon in which an electrode component is deposited on the work piece side while not being sufficiently melted is observed. Note that the relation between hardness of the electrode and a state of the film also slightly changes depending on discharge pulse conditions used. When appropriate discharge pulse conditions are used, it is possible to expand a range in which a satisfactory film can be formed to some extent. The same result was obtained concerning an electrode manufactured from powder with an average particle diameter not more than 1 micrometer.

According to the third embodiment, it is possible to form a dense thick film on a surface of a work by manufacturing an electrode for discharge surface treatment to have hardness of 25 to 60 from powder containing 40 volume percent or more of the material not forming carbide or the material less easily forming carbide and having an average particle diameters not more than 1 micrometer, and performing the discharge surface treatment using the electrode.

Fourth Embodiment

In a fourth embodiment of the present invention, an electrode for discharge surface treatment capable of increasing thickness of a film formed on a work according to a discharge surface treatment method is explained.

First, a change in hardness due to a size of a particle diameter forming the electrode for discharge surface treatment is explained. In press-molding powder at the pressing step at step S6 in the flowchart in FIG. 2, a pressure is transmitted from the powder in contact with a press surface or a die surface to an inner part of the electrode. In that case, the powder slightly moves. When an average particle diameter of the powder is about several tens micrometers, a size of a space formed in powder increases. The powder (on the surface of the electrode) in contact with the press surface or the die surface moves to fill the space. Density of particles present on the surface of the electrode increases and friction in that part increases. In other words, it is possible to hold a reaction force against a press pressure only with the surface of the electrode and a pressure is not transmitted to the inner part of the electrode. As a result, a distribution of hardness is formed in the electrode.

When treatment is performed using the electrode for discharge surface treatment having such a distribution of hardness, the electrode comes into one of the following two states. In a first state, an outer periphery of the electrode has optimum hardness and the inner part of the electrode is too soft. In this case, it is possible to deposit a film on a work in the outer periphery of the electrode. However, it is impossible to form a film or a coarse film is formed in the inner part of the electrode. In a second state, the outer periphery of the electrode is too hard and the inner part of the electrode is soft. In this case, since the electrode is not worn during the discharge surface treatment in the outer periphery thereof, removal machining is performed. However, a coarse film is formed on the work in the inner part of the electrode. When the outer periphery of the electrode is so hard that the removal machining for the surface of the work is performed, the inner part of the electrode is worn but the outer periphery there is not worn. Thus, a surface of the electrode on a side for electric discharge has a shape with the outer periphery projected. A larger number of electric discharges occur in the outer periphery. Consequently, concentration of electric discharge tends to be caused to make electric discharge unstable. All of these are not desirable in the discharge surface treatment.

Thus, a test was performed for hardness of the electrode for discharge surface treatment manufacture using powder with a small particle diameter and formation of a film. In this embodiment, an electrode for discharge surface treatment having a shape of 50 mm×11 mm×5.5 mm was manufactured according to the procedure described in FIG. 2 using only alloy powder with an average particle diameter of 1.2 micrometers. The alloy powder used in this case is an alloy with a ratio of 25 weight percent of Cr, 10 weight percent of Ni, 7 weight percent of W, 0.5 weight percent of C, and the remaining weight percent of Co. Other than the alloy powder having this composition, an alloy with a ratio of 28 weight percent of Mo, 17 weight percent of Cr, 3 weight percent of Si, and the remaining weigh percent of Co, an alloy with a ratio of 28 weight percent of Cr, 5 weight percent of Ni, 19 weight percent of W, and the remaining weight percent of Co, and the like may be used. Note that powder was compression-molded at a pressure of 67 MPa at the pressing step at step S6 in FIG. 2. To obtain electrodes having different degrees of hardness, a green compact was heated for one hour in a vacuum furnace at temperature of 730° C. and temperature of 750° C. at the heating step at step S7.

Figure 9:
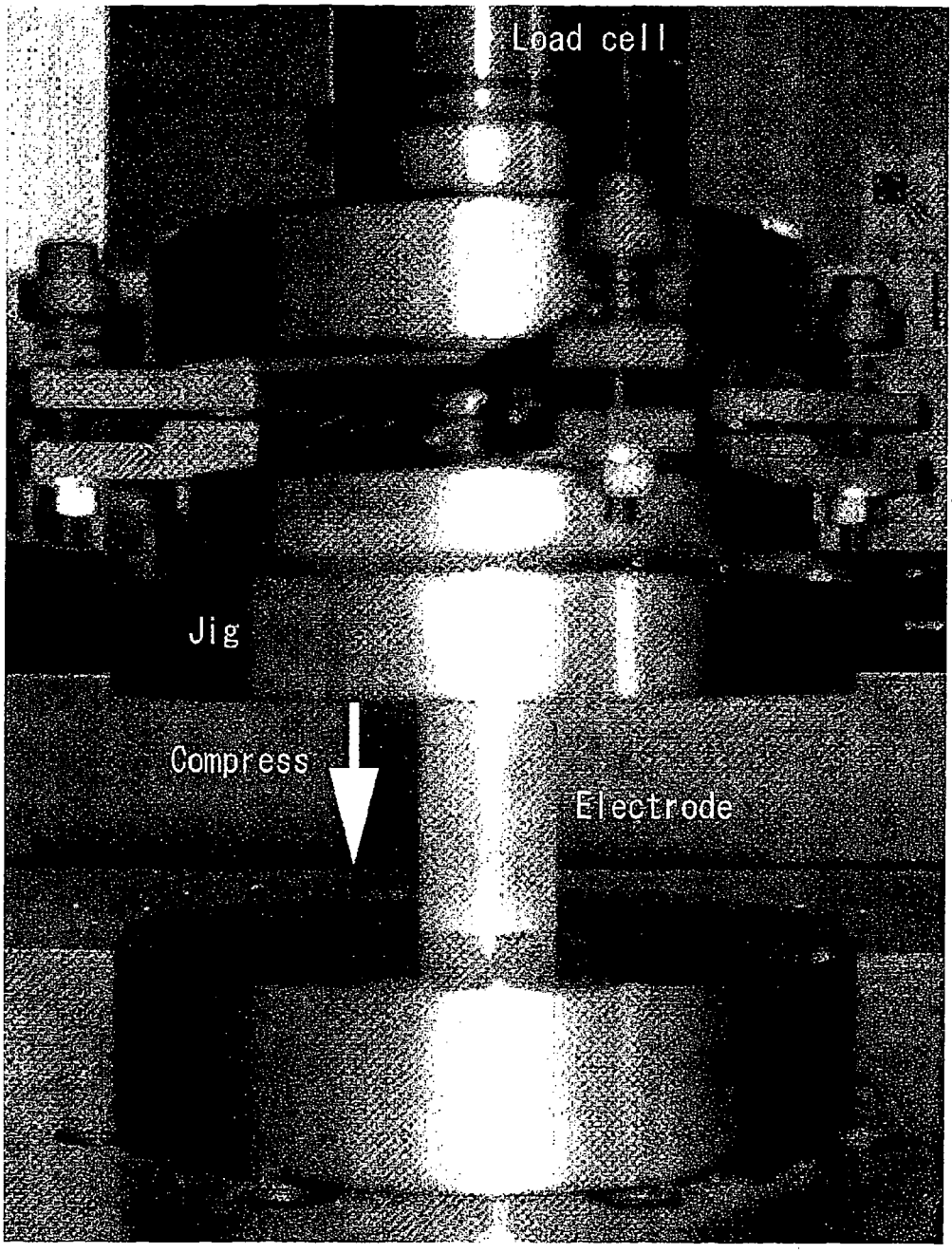
FIG. 9 is a photograph of a laboratory device for measuring compression strength of an electrode.

First, degrees of hardness of the respective electrodes manufactured by changing a heating temperature was investigated. Note that, in the fourth embodiment, compression strength of an electrode is used as hardness of the electrode. FIG. 9 is a photograph of a laboratory device for measuring compression strength of an electrode. In the laboratory device in FIG. 9, a force applied to the electrode is increased at a ratio of 1N per minute to measure the force applied to the electrode with a load cell above the electrode. When the force reaches a certain degree, a surface of the electrode is cracked and the applied force is released. Thus, compression strength of the electrode was calculated from a force immediately before the surface of the electrode is cracked. As a result, compression strength of the electrode heated at 730° C. was 100 MPa and compression strength of the electrode heated at 750° C. was 180 MPa.

A relation between compression strength of an electrode manufactured from alloy powder and a film thickness is explained. As conditions for the discharge surface treatment in this case, a peak current value was set to 10 amperes and a discharge duration (a discharge pulse width) was set to 4 microseconds.

Figure 10:
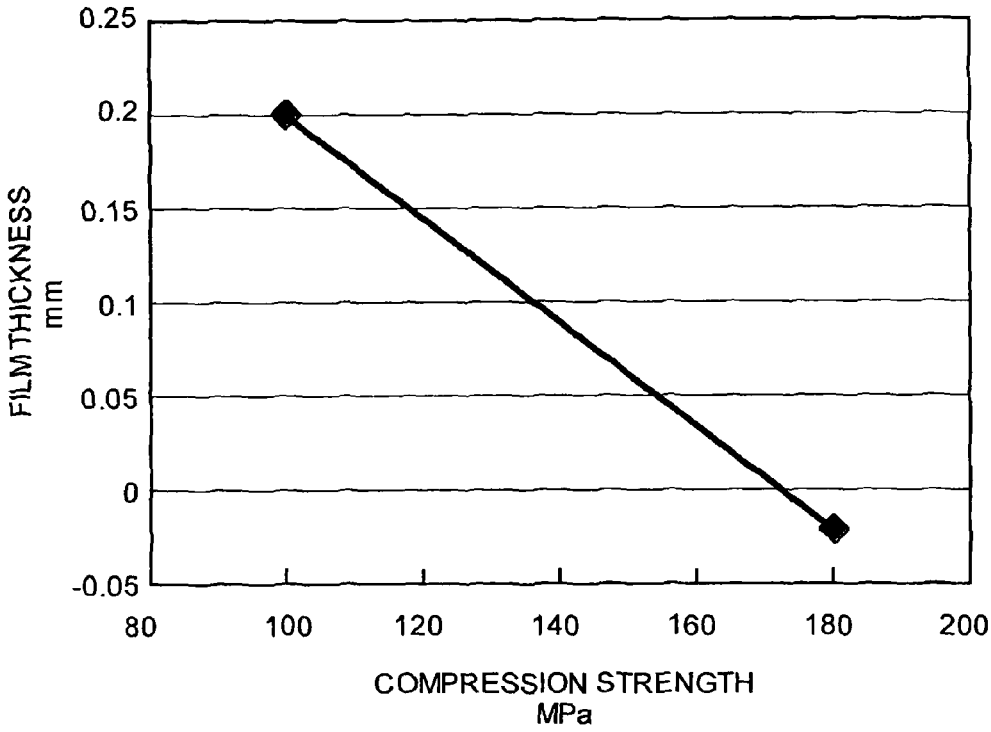
FIG. 10 is a graph of a relation between compression strength of an electrode and a film thickness.

FIG. 10 is a graph of a relation between compression strength of an electrode and a film thickness at the time when the discharge surface treatment is performed under the conditions described above. In FIG. 10, an abscissa indicates compression strength (MPa) of the electrode for discharge surface treatment and an ordinate indicates thickness (mm) of a film formed on a surface of a work when the discharge surface treatment is performed using the electrode for discharge surface treatment having the compression strength indicated by the abscissa. Values smaller than the film thickness of 0 millimeters on the ordinate represent removal machining for shaving the surface of the work when a film is not formed. As indicated by the figure, when compression strength of the electrode for discharge surface treatment is 100 MPa, it is possible to perform deposition machining on the surface of the work. However, when compression strength is 180 MPa, removal machining for the surface of the work is performed. In particular, compression strength of the electrode is required to be not more than 100 MPa to form a thick film having thickness equal to or larger than 0.2 millimeters on the work. Note that, when a peak of a current and discharge time increase, a quantity of electrode powder supplied from the electrode simply increases and a force for tearing off electrode powder does not increase. Thus, the same result as FIG. 10 was obtained under other machining conditions.

Compression strength of the electrode for discharge surface treatment manufactured by compression-molding powder depends on particles included in a unit volume and the number of bonds of the particles. When an average particle diameter increases, since the particles included in a unit volume and the number of bonds of the particles decrease, compression strength falls. This means that, when an average particle diameter is the same, it is possible to form a thick film from any material if compression strength is set to be not more than a certain value that makes it possible to form a thick film. For example, concerning hardness of the electrode, it has been found that, in the discharge surface treatment by a green compact electrode formed of alloy powder with an average particle diameter of about 1 micrometer, it is important to manage compression strength to be 100 MPa as an indicator for evaluation of an electrode for proper film formation. The compression strength serving as an indicator for evaluation of an electrode that makes it possible to form a thick film does not change even if a material changes as long as an average diameter is the same. However, when a material is changed, molding conditions such as a heating temperature and a press pressure for electrode manufacturing have to be changed.

As explained above, it is confirmed that one of main factors deciding possibility of formation of a thick film by the discharge surface treatment is hardness of an electrode. In other words, when powder with an average particle diameter of about 1 micrometer is used, it is possible to form a thick film on the surface of the work if a pressure or a heating temperature at the time of compression-molding is changed and the discharge surface treatment is performed with the electrode for discharge surface treatment manufactured to have compression strength not more than 100 MPa. A force generated by electric discharge acts to separate electrode powder and reaches a range of ϕ several tens micrometers to ϕ several millimeters. In other words, it is necessary to learn strength of the electrode in a magnitude of this order. For that purpose, compression strength making it possible to grasp macroscopic hardness of the electrode is optimum.

Moreover, when a particle diameter of powder of the electrode is reduced, even if the electrode is manufactured at the same press pressure and the same heating temperature, the number of particles per a unit volume increases. Although the number of surfaces of one particle bonding with particles around the particle does not change, the number of total bonding surfaces included in a unit volume increases. Thus, hardness of the electrode increases.

In recent years, a formation technology for powder has advanced to make it possible to manufacture metal powder and ceramic powder having an average particle diameter of 10 to 100 nanometers. Thus, an experiment was performed concerning a relation between compression strength and a film thickness at the time when an electrode for discharge surface treatment was manufacture using Ni powder with an average particle diameter of 50 nanometers. Note that, when an electrode is manufactured using powder with a nano-order average particle diameter, an electrode having sufficient strength is obtained only by press. Thus, the heating step at step S7 in FIG. 2 may be omitted. In this embodiment, the heating step is omitted. Discharge pulse conditions in the discharge surface treatment in the electrode manufactured were the same as those shown in FIG. 10. As a result of the experiment, it was confirmed that it was possible to perform deposition machining on a surface of a work when compression strength was smaller than 160 MPa but removal machining for the surface of the work was performed when compression strength was equal to or larger than 160 MPa.

Concerning electrode hardness of Ni powder with an average particle diameter of 50 nanometers, it has been found that, in the discharge surface treatment by a green compact electrode formed of Ni, it is important to manage compression strength to be 160 MPa as an indicator for evaluation of an electrode for proper film formation.

As described above, compression strength of the electrode manufactured by compression-molding powder depends on particles included in a unit volume and the number of bonds of the particles. When an average particle diameter decreases, since the particles included in a unit volume and the number of bonds of the particles increase, compression strength rises. As described above, it has been found that, in the discharge surface treatment by a green compact electrode formed of Ni powder with an average particle diameter of about 50 nanometers, it is important to manage compression strength to be 160 MPa as an indicator for evaluation of an electrode for proper film formation. This means that, when considered in conjunction with a result in the case of alloy powder with an average particle diameter of 1.2 micrometers, compression strength of the electrode that makes it possible to form a thick film is different depending on an average particle diameter. A value of the compression strength serving as an indicator for evaluation of an electrode for proper film formation does not depend on a quality of an electrode material as long as an average particle diameter is the same. Consequently, in determining whether an electrode for discharge surface treatment formed of powder with a small average diameter can deposit a thick film, compression strength of the electrode may be increased.

When the same experiment was performed using Co powder with an average particle diameter of 3 micrometers as another electrode material, it was confirmed that limit compression strength of an electrode that made it possible to deposit a film was about 50 MPa. In this case, it was confirmed that one of main factors deciding possibility of formation of a thick film by the discharge surface treatment was hardness of the electrode. In other words, it was confirmed that it was possible to form a thick film on a surface of a work if powder with an average particle diameter of 3 micrometers was used, a pressure or a heating temperature at the time of compression molding was changed, an electrode having compression strength not more than 50 MPa was manufactured, and the discharge surface treatment was performed with the electrode.

In this case, again, compression strength of the electrode manufactured by compression-molding powder depends on particles included in a unit volume and the number of bonds of the particles. Thus, a value of the compression strength serving as an indicator for evaluation of an electrode for proper film formation does not depend on a quality of an electrode material as long as an average particle diameter is the same. Consequently, in determining whether an electrode for discharge surface treatment formed of powder with a large average diameter can deposit a thick film, it is necessary to set compression strength of the electrode smaller.

Figure 11:
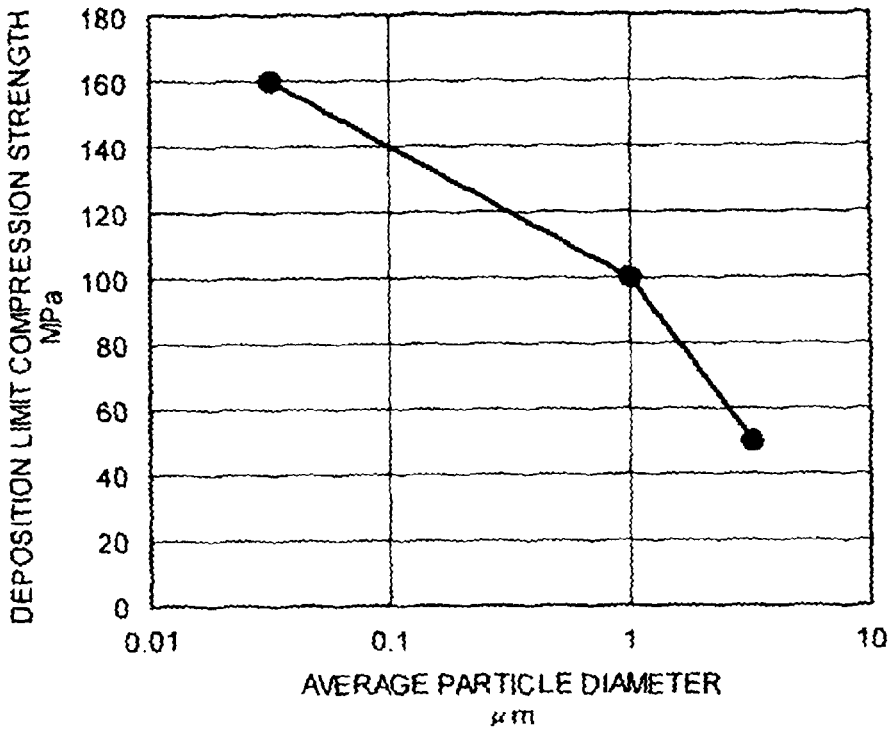
FIG. 11 is a graph of a relation between an average particle diameter and compression strength of an electrode that is capable of depositing a thick film.

FIG. 11 is a graph of a relation between an average particle diameter and compression strength of an electrode capable of depositing a thick film. In FIG. 11, an abscissa indicates an average particle diameter (μm) forming an electrode for discharge surface treatment in a logarithmic scale and an ordinate indicates deposition limit compression strength (MPa) that is compression strength of the electrode that makes it possible to form a film on a surface of a work. As shown in the figure, the deposition limit compression strength increases as the average particle diameter decreases.

According to the fourth embodiment, it is possible to form a dense thick film having lubricity under a high-temperature environment on a work by performing the discharge surface treatment using an electrode for discharge surface treatment manufactured to have compression strength not more than 100 MPa with powder having an average particle diameter of 1 micrometer as a material. It is possible to form a dense thick film having lubricity under a high-temperature environment on a work by manufacturing an electrode for discharge surface treatment to have compression strength not more than 160 MPa in the case of powder with an average particle diameter of 50 nanometers and to have compression strength not more than 50 MPa in the case of powder with an average particle diameter of 3 micrometers and performing the discharge surface treatment using the electrode for discharge surface treatment.

Moreover, according to the fourth embodiment, when the electrode for discharge surface treatment manufactured is used for the discharge surface treatment, it is possible to evaluate using compression strength of the electrode whether the electrode can deposit a thick film on a work. Consequently, when a large quantity of electrodes for discharge surface treatment are manufactured at a time under the same conditions, it is also possible to apply compression strength to an evaluation method for the electrodes. Specifically, a result of measurement of compression strength of one or several electrodes extracted from the electrodes manufactured in a large quantity at a time under the same conditions is used as evaluation of the electrodes manufactured simultaneously. This makes it possible to manage, even when a large quantity of electrodes are manufactured, qualities of all the electrodes.

Fifth Embodiment

In a fifth embodiment of the present invention, an electrode for discharge surface treatment capable of causing stable electric discharge without decreasing surface roughness and capable of depositing a thick film in the discharge surface treatment using metal powder as a green compact electrode is explained.

As explained in the first to the third embodiments, to form a thick film on a surface of a work according to the discharge surface treatment, a condition in terms of a material that a material not forming carbide or a material less easily forming carbide is added to components of an electrode material is important. However, there is a problem in that, simply by adding the material not forming carbide or the material less easily forming carbide in an electrode, vacancies remain in the thick film formed on the surface of the work and it is difficult to form a dense film. Thus, in the fifth embodiment, a technology necessary for forming a thick and dense film is explained.

In this embodiment, the technology is explained with a Co-based alloy (hereinafter simply referred to as Co alloy) containing 30% of Cr, 3% of Ni, 2% of Mo, 5% of W, 3% of Fe, and the like as an example. As Co alloy powder, one available on the market was used. Note that the Co alloy may be any alloy containing Co as a base such as a Co-based alloy containing 25% of Cr, 10% of Ni, 7% of W, and the like or a Co-based alloy containing 20% of Cr, 10% of Ni, 15% of W, and the like.

An electrode for discharge surface treatment was manufactured from Co alloy powder with an average particle diameter of about 3 micrometers according to the process in FIG. 2. A press pressure at the pressing step at step S6 in this case is preferably about 93 to 280 MPa. This is because, if the press pressure is higher than this, fluctuation occurs in hardness of the electrode and an air crack occurs in the electrode when press is performed.

When the discharge surface treatment is performed using the electrode for discharge surface treatment formed of the Co alloy powder manufactured as described above, a film of a Co alloy is formed on a surface of a work. However, it has been clarified through the experiment by the inventors that performance of the film is significantly affected by a ratio of powder serving as an electrode material in the electrode. Since the electrode is manufactured by compression-molding a powder material, there are a lot of spaces in the electrode. When the number of the spaces is too large, strength of the electrode falls and supply of the electrode material is not performed normally because of a pulse of electric discharge. For example, a phenomenon in which the electrode is collapsed in a wide area by an impact of electric discharge occurs. On the other hand, when the number of the spaces is too small, a phenomenon in which the electrode material adheres too firmly and supply of the electrode material by the pulse of electric discharge is decreased occurs. This makes it impossible to form a thick film.

The powder with a particle diameter of about 3 micrometers used in this embodiment is manufactured by grinding powder with a particle diameter of several tens micrometers and has a peak of a granularity distribution of a particle diameter at 3 micrometers. When an electrode was manufactured by compression-molding powder with a particle diameter that was uniform to some extent, according to the experiment of the inventors, a ratio of a volume of the electrode material in an electrode volume for an electrode capable of forming a satisfactory film was 25% to 50% (a remaining part of the electrode is a space). However, when the ratio of the volume of the electrode material (hereinafter, "ratio of the electrode material volume") was 25%, the electrode was rather soft and slightly lacked strength. Conversely, when the ratio of the electrode volume was 50%, the electrode was rather hard and an air crack occurred in a part of the electrode in some cases. A state of a film according to the ratio of the electrode material volume in this case is schematically shown in Table 1. However, this ratio changes more or less because of a distribution of powder particle diameters.

For example, when powder with a wide distribution of particle diameters is used, a space factor of the electrode (=(100−the ratio of the electrode material volume) %) tends to be small. Conversely, when powder with a narrow distribution of particle diameters is used, the space factor of the electrode tends to increase.

TABLE 1

| Ratio of Electrode Material Volume | State of Film |
|---|---|
| 15% | Electrode collapses and cannot be used |
| 20% | It is possible to form a film but the film is in a coarse state |

TABLE 1-continued

| Ratio of Electrode Material Volume | State of Film |
|---|---|
| 25% | It is possible to form a thick film, although the thick film is porous |
| 30% | It is possible to form a dense thick film |
| 40% | It is possible to form a dense thick film |
| 50% | It is possible to form a dense thick film but film formation is slow |
| 55% | A work is subjected to removal machining and it is impossible to form a thick film |

On the other hand, when powders with different particle diameters were mixed, for example, when powder with a particle diameter of about 6 micrometers was mixed in the powder with a particle diameter of about 3 micrometers used in the example described above, a ratio of an electrode material volume in an electrode volume for an electrode capable of forming a satisfactory film was in a range of 40% to 65%. However, when the ratio of the electrode material volume was 40%, the electrode was rather soft and slightly lacked strength. Conversely, when the ratio of the electrode material volume was 65%, the electrode was rather hard. A state of a film according to the ratio of the electrode material volume is schematically shown in Table 2.

TABLE 2

| Ratio of Electrode Material Volume | State of Film |
|---|---|
| 30% | Electrode collapses and cannot be used |
| 35% | It is possible to form a film but the film is in a coarse state |
| 40% | It is possible to form a thick film, although the thick film is porous |
| 50% | It is possible to form a dense thick film |
| 60% | It is possible to form a dense thick film |
| 65% | It is possible to form a dense thick film but film formation is slow |
| 70% | A work is subjected to removal machining and it is impossible to form a thick film |

According to the fifth embodiment, the discharge surface treatment is performed using the electrode for discharge surface treatment taking into account a volume ratio of the electrode material in the electrode volume. Thus, it is possible to form a dense film without vacancies on a work even when an electrode for discharge surface treatment manufactured with metal powder as a material is used.

Note that, in the description of the Patent Document 2, an electrode of ceramics that can be formed at an extremely high pressure and is compression molded to have density of 50% to 90% of a logical density is used. However, the electrode is not an electrode that forms a dense metal thick film as in the fifth embodiment. A technical scope, an application, and an effect of the film are also different from those of the electrode in the fifth embodiment.

Sixth Embodiment

In a sixth embodiment of the present invention, discharge surface treatment for depositing a thick film in the discharge surface treatment using an electrode for discharge surface treatment manufactured by compression-molding metal powder is explained.

In an electrode for discharge surface treatment manufactured according to the process shown in FIG. 2, when bonding between powders is strong, heat moves smoothly between the powders, that is, a thermal conductivity increases. On the other hand, when the bonding is weak, heat does not move smoothly between the powders and the thermal conductivity decreases. When a heating temperature is raised, metal bonding between powders progresses and the thermal conductivity of the electrode increases. On the other hand, when the heating temperature is lowered, metal bonding between powders does not progress much and the thermal conductivity of the electrode decreases.

When the thermal conductivity (energy per a unit length and a unit temperature) of the electrode is small, the electrode has a high temperature locally. Thus, it is possible to vaporize an electrode material instantly with heat of electric discharge. A melted portion or a solid portion of the electrode is torn from the electrode by an explosive force of the electric discharge. The electrode material separated from the electrode is deposited on a surface of a work. On the other hand, when the thermal conductivity of the electrode is large, since heat tends to be diffused, a heat spot occurs less easily and the electrode material hardly vaporizes. Therefore, the explosive force is not generated and the electrode material can hardly be supplied. Consequently, to form a thick film on the surface of the work, it is necessary deposit the electrode material on the work in an amount larger than an amount of removal of a material forming the work due to heat of the electric discharge. For that purpose, the thermal conductivity of the electrode for discharge surface treatment has to be small.

Reduction of the thermal conductivity of the electrode for discharge surface treatment is explained below. An electrode for discharge surface treatment having a shape of 50 mm×11 mm×5.5 mm was manufactured according to the process in FIG. 2 using only alloy powder with an average particle diameter of 1.2 micrometers. The alloy powder used in this case is an alloy with a ratio of 25 weight percent of Cr, 10 weight percent of Ni, 7 weight percent of W, 0.5 weight percent of C, and the remaining weight percent of Co. Other than the alloy powder having this composition, an alloy with a ratio of 28 weight percent of Mo, 17 weight percent of Cr, 3 weight percent of Si, and the remaining weigh percent of Co, an alloy with a ratio of 28 weight percent of Cr, 5 weight percent of Ni, 19 weight percent of W, and the remaining weight percent of Co, and the like may be used. Note that powder was compression-molded at a pressure of 67 MPa at the pressing step at step S6 in FIG. 2. To obtain electrodes having different degrees of hardness, a green compact was heated for one hour in a vacuum furnace at temperature of 730° C. and temperature of 750° C. at the heating step at step S7.

First, thermal conductivities of electrodes manufactured by changing a heating temperature were checked according to a laser flash method. As a result, a thermal conductivity of an electrode heated at 730° C. was 10 W/mK and a thermal conductivity of an electrode heated at 750° C. was 12 W/mK.

Figure 12:
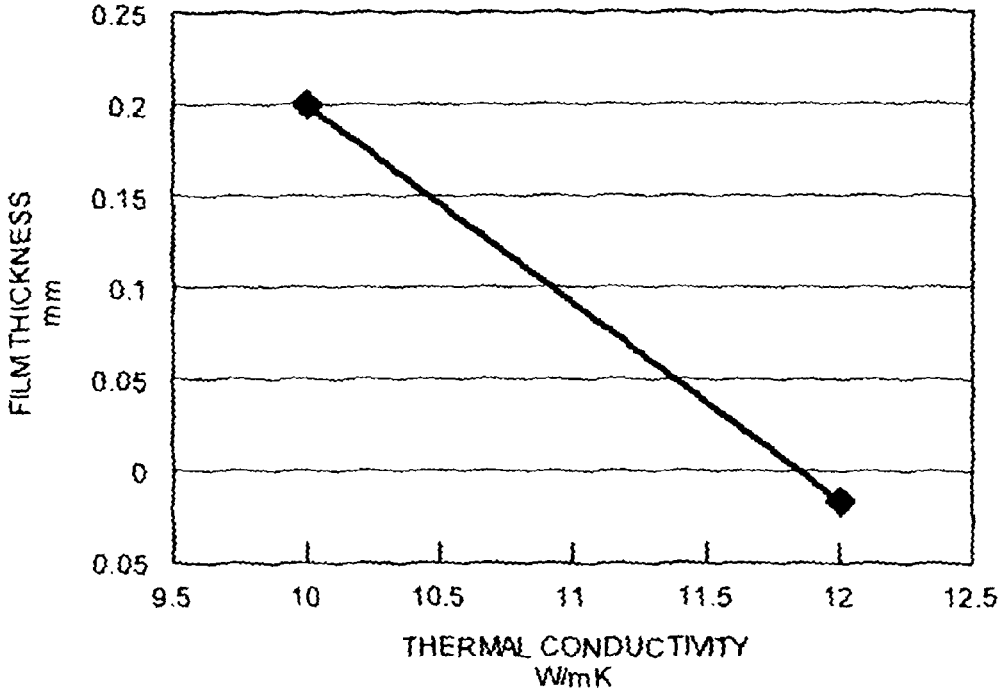
FIG. 12 is a graph of a relation between a film thickness formed on a surface of a work and a thermal conductivity of an electrode for discharge surface treatment at the time when discharge surface treatment is performed using electrodes for discharge surface treatment with different thermal conductivities.

FIG. 12 is a graph of a relation between thickness of a film formed on a surface of a work and a thermal conductivity of an electrode for discharge surface treatment at the time when the discharge surface treatment is performed for five minutes using electrodes for discharge surface treatment having different thermal conductivities. In FIG. 12, an abscissa indicates a thermal conductivity (W/mK) of an electrode for discharge surface treatment and an ordinate indicates thickness (mm) of a film formed on a surface of a work when the discharge surface treatment is performed by the electrode for discharge surface treatment having the thermal conductivity indicated on the abscissa. Note that, when a value of the film thickness on the ordinate is negative, the value represents removal machining. As shown in the figure, when a machining time is the same, the film thickness increases as the thermal conductivity is smaller. When the thermal conductivity of the electrode is set to about 11.8 W/mK or more, removal machining for removing the surface of the work is performed. Consequently, it has been found by the experiment that the thermal conductivity of the electrode has to be not more than 11.8 W/mK to form a thick film. In particular, the thermal conductivity of the electrode is required to be not more than 10 W/mK to form a thick film with thickness equal to or larger than 0.2 millimeter.

When a surface, on which electric discharge occurred, of an electrode for discharge surface treatment with the thermal conductivity of 12 W/mK is observed after the discharge surface treatment, it is possible to confirm metallic luster that is a result obtained when powder of the electrode is melted and re-solidified. In other words, the surface on which electric discharge occurred is not a green compact in which powders are slightly bonded but a re-solidified body that is formed when metal powders are melted and bonded together. On the other hand, luster is not observed in a state of a surface on which electric discharge of an electrode for discharge surface treatment with the thermal conductivity of 10 W/mK has occurred.

In this way, a heat spot is not formed on the electrode when the thermal conductivity is equal to or higher than 10 W/mK and a portion where the electrode and an arc column are in contact with each other hardly vaporizes. Thus, an explosive force is reduced and all melted areas formed on the electrode are not removed but remain on the surface of the electrode. The melted areas are accumulated according to repetition of electric discharge and a metal layer melted and re-solidified is formed on the surface of the electrode. When such a metal layer is formed, no electrode powder moves from the electrode to the work and removal machining for removing the surface of the work is performed.

Note that, in the sixth embodiment, the alloy powder having the composition described above is explained. However, even if Co alloy powder, Ni alloy powder, or Fe alloy powder is used, it is possible to form a thick film if an electrode with the thermal conductivity set to 10 W/mK or less is manufactured in the same manner and the discharge surface treatment is performed using the electrode.

The electrode is a green compact obtained by compression-molding powder. What determines (dominates) a thermal conductivity of the electrode is a bonding state between powders rather than a material of electrode powder. Therefore, it is possible to form a thick film on the work if the electrode is manufactured to have the thermal conductivity not more than 10 W/mK for all materials. For example, even when Cu (about 300 W/mK) or Al (200 W/mK) with a high thermal conductivity is used, it is possible to form a thick film on the surface of the work if a thermal conductivity of an electrode manufactured from the powder satisfies the thermal conductivity described above (10 W/mK). It is impossible to form a film on the work if the thermal conductivity is equal to or higher than the thermal conductivity described above.

According to the sixth embodiment, it has been proved by the experiment that it is possible to form a thick film when an electrode with a thermal conductivity not more than 10 W/mK is used. Usefulness of using the value as an index necessary for an electrode for forming a thick film has also been proved. In this way, if a thermal conductivity is used as an index for an electrode, there is an advantage that it is possible to easily evaluate an electrode that can form a thick film.

Note that, concerning a thermal conductivity of an electrode for discharge machining, Japanese Patent Application Laid-Open No. S54-124806 describes that the thermal conductivity of the electrode is set to 0.5 Kcal/cm·sec·° C. or less. However, the invention described in Japanese Patent Application Laid-Open No. S54-124806 relates to discharge machining having an object of preventing wear of an electrode and transferring an electrode shape onto a work. The invention does not relate to an electrode for discharge surface treatment for forming a film on a work as in the present invention.

Japanese Patent Application Laid-Open No. S54-124806 does not describe a lower limit value of a thermal conductivity. However, it is obvious that, when a thermal conductivity of an electrode is reduced (e.g., 10 W/mK), a heat spot is formed on the electrode, the electrode is worn, and it is impossible to attain the object of electric discharge machining for transferring a machining shape. In other words, the invention described in Japanese Patent Application Laid-Open No. S54-124806 has an object and a method significantly different from those of the discharge surface treatment in the sixth embodiment for forming a film on a work by actively wearing an electrode. Moreover, the value 0.5 Kcal/cm·sec·° C. (=209303 W/mK) is too large and is far higher than a value 398 W/mK of pure copper that has conventionally considered to have a highest thermal conductivity.

According to the sixth embodiment, the discharge surface treatment is performed using the electrode for discharge surface treatment with the thermal conductivity not more than 10 W/mK. Thus, it is possible to form a thick film on a work even with an electrode for discharge surface treatment manufactured using metal powder as a material.

As explained above, according to the present invention, an electrode for discharge surface treatment is manufactured such that hardness, compression strength of the electrode, a ratio of an electrode material volume in a volume of the electrode, or a thermal conductivity of the electrode is within a predetermined range according to a particle diameter of powder. The discharge surface treatment is performed using the electrode. Thus, it is possible to form a thick dense film on a work.

Seventh Embodiment

In a seventh embodiment of the present invention, as an evaluation method for an electrode, a method of actually causing continuous electric discharge according to predetermined conditions and evaluating a quality of an electrode based on an amount of wear of the electrode, machining time, and thickness of a film formed is explained.

The alloy powder (ground into powder with an average particle diameter of 1.2 micrometers) described in the fourth embodiment was compression-molded to manufacture an electrode for discharge surface treatment having a shape of 50 mm×11 mm×5.5 mm. A process for the electrode manufacturing is identical with that in the fourth embodiment. A powder particle diameter, manufacturing conditions, and the like of the electrode manufactured in this way are managed. However, fluctuation may occur in the powder particle diameter, the manufacturing conditions, and the like depending on a difference of temperature and humidity at the time of manufacturing, a ground state of powder, a mixed state of wax and powder, and the like. The method of managing such fluctuation according to electrode harness and the like has been explained as described above. Other than the method, it is possible to check fluctuation by forming a film using an electrode.

Figure 13A:
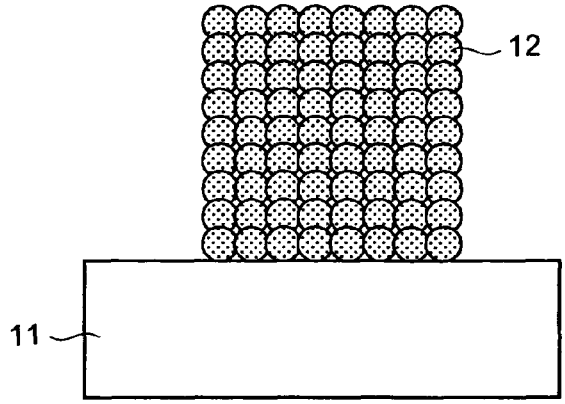
FIG. 13A is a schematic diagram of a method of judging a quality of an electrode according to a film formation test.
Figure 13B:
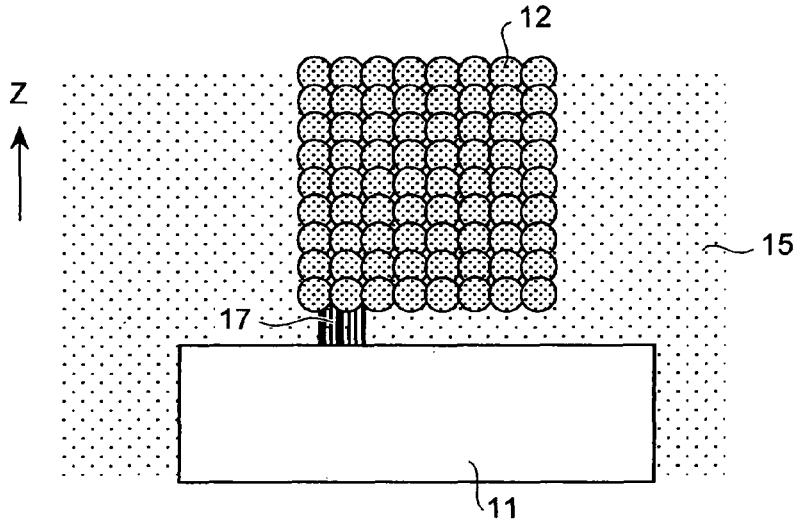
FIG. 13B is a schematic diagram of a method of judging a quality of an electrode according to a film formation test.
Figure 13C:
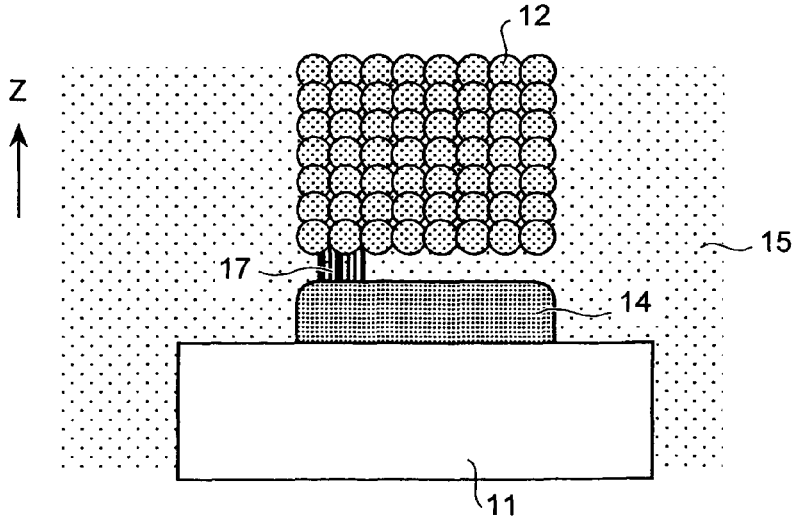
FIG. 13C is a schematic diagram of a method of judging a quality of an electrode according to a film formation test.

FIGS. 13A to 13C are diagrams for schematically explaining a method of judging a quality of an electrode according to a film formation test. In the figures, components identical with those in FIG. 1 in the first embodiment are denoted by the identical reference numerals. Note that, since the figures are figures for schematic explanation concerning a judgment method, components such as a power supply and a driving shaft are omitted.

In an evaluation method for an electrode in the seventh embodiment, a film is formed according to the discharge surface treatment of a predetermined amount using the electrode manufactured as described above. In the case of the electrode described above, it is desirable for convenience of machining to set the electrode such that a surface with a size of 11 mm×5.5 mm serves as a discharge surface. However, the electrode may be set such that another surface serves as the discharge surface. First, as shown in FIG. 13A, positioning of the electrode 12 and the work 11 is performed. Subsequently, as shown in FIG. 13B, electric discharge is started to perform film formation. As shown in FIG. 13C, the film 14 is formed on the work 11. In FIGS. 13B and 13C, reference numeral 17 denotes an arc column for electric discharge. A film formation time and thickness of a formed film were measured while a distance for driving the electrode 12 downward along a Z axis in the figure was kept at a predetermined value. Note that a feed amount in the Z axis direction was set to 2 millimeters. Since the electrode is fed 2 millimeters in the Z axis direction, an electrode wear amount (length) after the film formation is calculated as 2 mm+(thickness of the formed film)+(discharge gap). The discharge gap is about several tens to 100 micrometers. As the discharge surface treatment conditions, the peak current value ie was set to 10 amperes and the discharge duration (discharge pulse time) te was set to 4 microseconds. A result obtained by actually performing a film formation test is shown in Table 3.

TABLE 3

| Electrode Number | Film Formation Time (min) | Film Thickness (mm) | Tensile Strength (MPa) |
|---|---|---|---|
| No. 1 | 16 | 0.35 | 35 |
| No. 2 | 20 | 0.11 | 25 |
| No. 3 | 16 | 0.34 | 35 |
| No. 4 | 16 | 0.35 | 35 |
| No. 5 | 13 | 0.30 | 20 |

In Table 3, the electrode number is a unique number given to an electrode. The film formation time indicates a discharge surface treatment time. The film thickness indicates thickness of a film formed within the film formation time. The tensile strength indicates a pressure at which a film was ruptured when a test piece was stuck to an upper surface of a film formed on the work 11 with an adhesive and a tensile test was performed for the work and the test piece stuck to the film using a tensile tester.

The film formation time was 16 minutes and the film thickness in the film formation time was 0.35 millimeters for the electrode with the electrode No. 1. The film formation time and the film thickness were substantially the same for the electrode with the electrode Nos. 3 and 4. Compared with the electrode with the electrode No. 1, the film formation time for the electrode with the electrode No. 2 is long at 20 minutes but the film thickness thereof is small. Conversely, the film formation time for the electrode with the electrode No. 2 is short at 13 minutes and the film thickness thereof is 0.30 millimeters. Strength of the films formed by these electrodes tends to fall when the treatment time is longer or shorter than a normal treatment time (about 16 minutes). It is seen that there are optimum values for a treatment time and thickness of a film that can be formed. The optimum values are different depending on an electrode material, an electrode shape, treatment conditions, and the like. However, it is possible to judge quality of an electrode from a film formation time and a film thickness at the time when film formation is performed under predetermined conditions. It is possible to set a criterion for the judgment such that, for example, an electrode with a treatment time in a range of ±10% from an average treatment time is judged as acceptable and an electrode with a treatment time deviating from the range is judged as unacceptable.

A quality of an electrode is judged in the same manner based on thickness of a film. For example, the test described above is performed with a feed amount of the electrode set to the predetermined value. However, it is also possible that a treatment time is set to a predetermined time, a film thickness in the treatment time is set as a judgment criterion, and an electrode with a film thickness in a range of ±10% from an average value is judged as acceptable and an electrode with a film thickness deviating from the range is judged as unacceptable.

According to the seventh embodiment, it is possible to judge a quality of an electrode using a film formation time or a film thickness at the time when a film is formed on a work by the electrode under predetermined conditions.

INDUSTRIAL APPLICABILITY

As described above, the present invention is suitable for a discharge surface treatment apparatus capable of automating treatment for forming a thick film on a surface of a work.

The invention claimed is:

1. A method for discharge surface treatment of a work piece with an electrode, the electrode being made of a green compact obtained by compression-molding an electrode material including powder of any of a metal, a metallic compound, and ceramics, and the discharge surface treatment generating an electric discharge between the electrode and the work piece in an atmosphere of a machining medium and forming a film consisting of a machining material on a surface of a work piece using energy produced by the electric discharge, comprising:

using in the discharge surface treatment an electrode made of a powder that has an average particle diameter of 1 micrometer to 5 micrometers and contains 40 volume percent or more of a component not forming or less easily forming carbide as a component for forming the film on the work piece, and that has a hardness in a range of 20 to 50 in hardness $H=100-1000\times h$ calculated when a press-in distance at the time when a steel ball with a diameter of ¼ inch is pressed against the electrode at 15 kgf is h (μm).

2. The method according to claim 1, wherein the component not forming carbide or less easily forming carbide is selected from the group consisting of Co, Ni, Fe, Cu, and Zn.

3. A method for discharge surface treatment of a work piece with an electrode, the electrode being made of a green compact obtained by compression-molding an electrode material including powder of any of a metal, a metallic compound, and ceramics, and the discharge surface treatment generating an electric discharge between the electrode and the work piece in an atmosphere of a machining medium and forming a film consisting of a machining material on a surface of a work piece using energy produced by the electric discharge, comprising:

using in the discharge surface treatment an electrode made of a powder that has an average particle diameter of 1 micrometer to 5 micrometers and contains 40 volume percent or more of a component not forming or less easily forming carbide as a component for forming the film on the work piece, and that has a hardness in a range of 25 to 60 in hardness $H=100-1000\times h$ calculated when a press-in distance at the time when a steel ball with a diameter of ¼ inch is pressed against the electrode at 15 kgf is h (μm).

4. The method according to claim 3, wherein the component not forming carbide or less easily forming carbide is selected from the group consisting of Co, Ni, Fe, Cu, and Zn.

5. A method for discharge surface treatment of a work piece with an electrode, the electrode being made of a green compact obtained by compression-molding an electrode material including powder of any of a metal and a metallic compound, and the discharge surface treatment generating an electric discharge between the electrode and the work piece in an atmosphere of a machining medium and forming a film of a machining material on a surface of a work piece using energy produced by the electric discharge, comprising:

when an average particle diameter of the powder is plotted on a logarithmic scale in micrometers and a compression strength used in the compression-molding is plotted on a normal scale in MPa, the compression strength used in the compression-molding is lower than a compression strength represented by a line on the plot obtained by joining points average particle diameter: 0.05 micrometer, compression strength: 160 MPa, average particle diameter: 1 micrometer, compression strength: 100 MPa, and average particle diameter: 3 micrometers, compression strength: 50 Mpa.

6. The method according to claim 5, wherein the powder is selected from the group consisting of Co powder, Co alloy powder, Ni powder, and Ni alloy powder.

* * * * *